US009114665B2

(12) United States Patent
Ohashi

(10) Patent No.: US 9,114,665 B2
(45) Date of Patent: Aug. 25, 2015

(54) TRANSFER MEMBER, METHOD FOR MANUFACTURING TRANSFER MEMBER, AND TRANSFERRED MEMBER

(75) Inventor: Masakazu Ohashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 13/252,645

(22) Filed: Oct. 4, 2011

(65) Prior Publication Data

US 2012/0081485 A1 Apr. 5, 2012

(30) Foreign Application Priority Data

Oct. 4, 2010 (JP) ..... 2010-224640
Feb. 8, 2011 (JP) ..... 2011-025442
Feb. 16, 2011 (JP) ..... 2011-030538

(51) Int. Cl.
*B41J 2/01* (2006.01)
*B44C 1/17* (2006.01)

(52) U.S. Cl.
CPC ..... *B44C 1/1704* (2013.01)

(58) Field of Classification Search
CPC ..... B41J 2/01; B41J 2002/012; B32B 38/18
USPC ..... 347/103
See application file for complete search history.

(56) References Cited

U.S. PATENT DOCUMENTS 6,120,130 A * 9/2000 Hirano et al. ..... 347/46
6,402,316 B1 * 6/2002 Ichinose ..... 347/101
6,565,204 B2 5/2003 Matsuhashi et al.
6,626,531 B2 * 9/2003 Fujii et al. ..... 347/105
6,686,314 B2 * 2/2004 Xu et al. ..... 503/227
7,470,649 B2 12/2008 Nakane et al.
2003/0071884 A1 * 4/2003 Iwasa et al. ..... 347/105
2003/0081093 A1 * 5/2003 Iijima et al. ..... 347/100
2003/0174195 A1 * 9/2003 Onishi et al. ..... 347/105
2006/0055762 A1 * 3/2006 Ushiku et al. ..... 347/105
2006/0177649 A1 * 8/2006 Clark et al. ..... 428/335
2008/0277630 A1 11/2008 Kiyoshima et al.
2009/0075075 A1 * 3/2009 Abrams ..... 428/354
2009/0207223 A1 * 8/2009 Cofler et al. ..... 347/102
2009/0213173 A1 * 8/2009 Masuda et al. ..... 347/33
2011/0032315 A1 * 2/2011 Ikuno et al. ..... 347/85

FOREIGN PATENT DOCUMENTS

JP 2000-043400 A 2/2000
JP 2000-168250 A 6/2000
JP 2001-341417 A 12/2001
JP 2002179960 A 6/2002
JP 2002-254896 A 9/2002
JP 2005-349823 A 12/2005
JP 2006-124826 A 5/2006
JP 2006-341416 A 12/2006
JP 2008-044130 A 2/2008
JP 2009-107283 A 5/2009

* cited by examiner

*Primary Examiner* — Alessandro Amari
*Assistant Examiner* — Alexander C Witkowski
(74) *Attorney, Agent, or Firm* — Nutter McClennen & Fish LLP; John J. Penny, Jr.

(57) ABSTRACT

Disclosed is a transfer member including a permeable layer, a pigment layer formed on the permeable layer by an ink jet method, and an adhesive layer having adhesivity formed on the pigment layer, wherein a dispersion medium of an ink containing a pigment to form the pigment layer permeates into the permeable layer.

14 Claims, 7 Drawing Sheets

TRANSFER MEMBER, METHOD FOR MANUFACTURING TRANSFER MEMBER, AND TRANSFERRED MEMBER

Priority is claimed under 35 U.S.C. §119 to Japanese Application No. 2010-224640 filed on Oct. 4, 2010, Application No. 2011-025442 filed on Feb. 8, 2011, and Application No. 2011-030538 filed on Feb. 16, 2011 are hereby incorporated by reference in its entirety.

BACKGROUND

1. Technical Field

The present invention relates to a transfer member, a method for manufacturing a transfer member and an apparatus for manufacturing a transfer member.

2. Related Art

In the related art, there is a demand for materials in which glossy or shiny images are recorded in order to improve design effects and appearance. Examples of recording media on which images are recorded include paper and films used for packing or packages of cosmetics, medicine and the like, and fabrics and leathers used for clothes, daily necessities and the like. Generally, a prerequisite to impart gloss or shine to images is an even surface for images. In particular, an even surface becomes essential for glitter images.

Examples of methods for recording glitter images on a recording medium known in the art include a stamping method in which a recording medium having a highly even recording surface is selected and a metal foil is pressed on the recording medium to record an image, and a method for depositing a metal on a recording medium such as a plastic film having an even recording surface. In addition, examples of methods for forming glitter images by coating a recording medium with a glitter pigment include screen printing, transfer printing and the like.

A method known in the related art similar to the stamping or transfer printing method is for example a printing method disclosed in JP-A-2008-044130. In addition, a method comprising forming an image using an ink containing a metal pigment and flattening the surface of the image by pressing was suggested as a method known in the art for forming a glitter image by applying a glitter pigment to a recording medium by an ink jet method (for example, JP-A-2002-179960).

Meanwhile, for example, JP-A-2009-107283 discloses a method for forming a glitter image on a recording medium using transfer as a transfer printing method. This document discloses a method in which a metal pigment ink is applied to a substrate including an ink accepting layer and a thermal adhesive layer through the thermal adhesive layer and the ink is transferred together with the ink accepting layer to another medium through the thermal adhesive layer.

However, the deposition and screen printing methods are commonly performed using a large-scale apparatus. For example, the screen printing method has no great problem in the case of manufacturing bulky recording materials, but when recording materials are evaluated through sample printing or test printing or a small amount of other types of recording materials are produced, manufacturing of a plate is required for each recording process and this is insufficient from the viewpoint of the efforts, consumed time and costs. Furthermore, there are great difficulties associated with deposition or screen printing, when consumers and the like make recording materials in the house or workplace.

In addition, in accordance with a stamping or transfer printing method of the related art, the ink present in a region corresponding to the desired image is transferred from a film in which the entire surface thereof is coated with a metal foil or glitter ink to a recording medium. For this reason, there are problems such as great waste of metal or ink and disposal of the used films.

Meanwhile, a recording method using an ink jet method is superior to a screen printing method in that the method can be performed using relatively small-scale equipment and waste of used ink (metal) can be suppressed. However, for example, in order to impart excellent photoluminescence to images formed by an ink jet method, there are restrictions such as flattening of the surface of images, additional processes such as pressing and a necessity of using highly even recording media. For this reason, with a recording method using the ink jet method, it is difficult to record excellent glitter images on recording media with a lack of surface evenness such as general paper or fabrics.

In addition, JP-A-2009-107283 described above discloses that a metal pigment which permeates into an ink accepting layer exhibits photoluminescence. This method requires a thermal adhesive layer which cause permeation of an ink, a transparent ink accepting layer and a metal pigment (particle diameter of 20 nm) which can permeate a thermal adhesive layer and has a limited selection of these materials. Furthermore, obtainable photoluminescence of images is realized through the ink accepting layer, thus disadvantageously making it difficult to secure evenness of the glitter surface and exhibit inherent photoluminescence of the ink.

SUMMARY

An advantage of some aspects of the invention is to provide an image formation method, an image forming device, a recording material, and a recording material formed thereby, capable of forming images with good gloss or shine on the recording medium, regardless of the type of recording medium.

The invention was made to accomplish at least a part of the advantages of the invention and will be realized by the following aspects and applications.

Application 1

According to an aspect of the invention, there is provided a transfer member including: a permeable layer; a pigment layer formed on the permeable layer by an ink jet method; and an adhesive layer having adhesivity formed on the pigment layer, wherein a dispersion medium of an ink containing a pigment to form the pigment layer permeates into the permeable layer.

Application 2

In addition, a medium to be transferred may be disposed with respect to the adhesive layer and the pigment layer may be adhered to the transferred medium through the adhesive layer.

Application 3

The pigment may be glitter.

Application 4

The transfer member may further include a chromatic color layer between the pigment layer and the adhesive layer.

Application 5

According to another aspect of the invention, there is provided a method for manufacturing a transfer member including: adhering an ink containing a pigment to a permeable layer by an ink jet method and allowing at least a part of a dispersion medium of the ink into the permeable layer to form a pigment layer on the permeable layer; forming an adhesive layer having adhesivity on the pigment layer; and arranging a medium to be transferred on the adhesive layer and adhering the transferred medium to the pigment layer.

Application 6

The formation of the adhesive layer may be carried out using an ink jet method.

Application 7

According to another aspect of the invention, there is provided a method for manufacturing a transfer member including: adhering an ink containing a pigment to a permeable layer by an ink jet method and permeating a dispersion medium of the ink into the permeable layer to form a pigment layer on the permeable layer; and disposing a medium to be transferred including an adhesive layer having adhesivity with respect to the pigment layer and adhering the transferred medium to the pigment layer through the adhesive layer.

Application 8

The pigment may be glitter.

Application 9

The pigment may have a mean particle diameter of 3 nm to 200 nm.

Application 10

The method for manufacturing a transfer member may further include: separating the permeable layer from the pigment layer and transferring the pigment layer from the permeable layer to the transferred medium.

Application 11

The transferred medium may be a transferred medium having an arithmetical mean roughness (Ra) of 20 μm or more, or a transferred medium having no ink-absorbency or low ink-absorbency.

Application 12

According to still another aspect of the invention, there is provided a transferred member formed by the method according to the aspect, the transferred member comprising the transferred medium, the adhesive layer and the pigment layer.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Exemplary Embodiment

Hereinafter, considerably preferred exemplary embodiments of the invention will be described. The exemplary embodiments described below are provided for illustration of examples of the invention. In addition, the invention is not limited to the following exemplary embodiments and also includes a variety of modified examples which may be accomplished within the range which does not vary the subject matters of the invention. In addition, all the configurations of the exemplary embodiments described below are not limited as being indispensible constituent components of the invention.

1. Transfer Member

Figure 1:
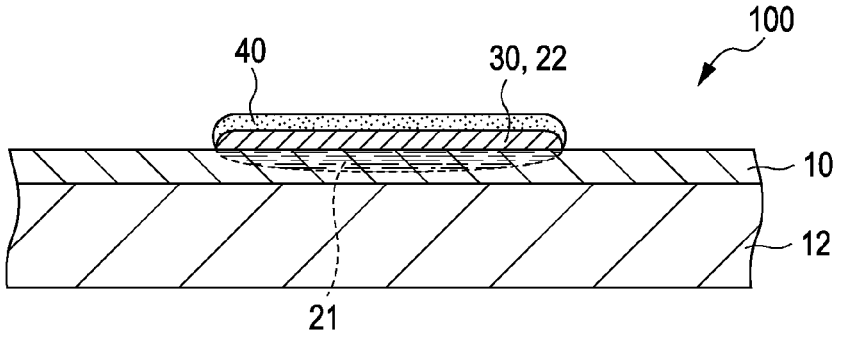
FIG. 1 is a schematic cross-sectional view illustrating a recording material according to an exemplary embodiment.
Figure 2:
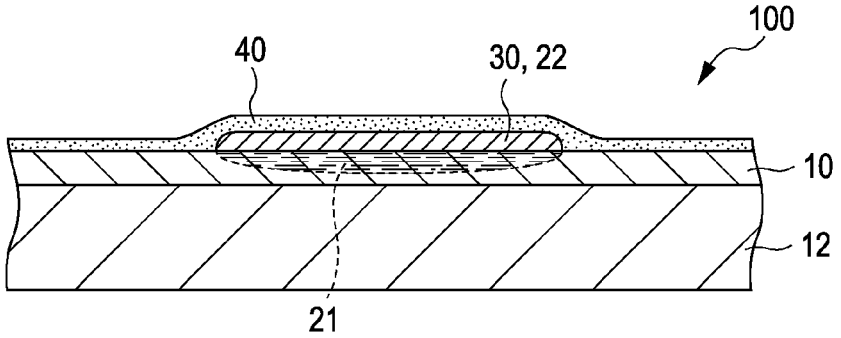
FIG. 2 is a schematic cross-sectional view illustrating a recording material according to an exemplary embodiment.

The recording material according to this exemplary embodiment includes a permeable layer 10, a pigment layer 30 and an adhesive layer 40. FIGS. 1 and 2 are schematic cross-sectional views illustrating a transfer member 100 according to an exemplary embodiment.

1.1. Permeable Layer

For example, the permeable layer includes a swelling layer having a sheet, film or membrane shape or a porous layer in which inorganic particles such as silica and alumina are packed on the entire surface thereof. In the exemplary embodiment, the permeable layer 10 is a porous layer. More specifically, the term "porous layer" refers to a layer which is not an ink absorbing layer containing a water-soluble or hydrophilic polymer as a main component, in which inorganic particles are filled in the layer and a liquid permeates between the inorganic particles or in voids of pores provided in the inorganic particles. At least a part of the surface of the permeable layer 10 has sufficient evenness to impart evenness to the pigment layer 30 described below.

The thickness of the permeable layer 10 is for example 5 μm to 50 μm. The size (area) of the permeable layer 10 is not particularly limited. For example, the permeable layer 10 may be a single sheet having a general paper (such as A4) size or a long object such as a continuous paper or roll. The permeable layer 10 may be used singly, when it has a sufficient mechanical strength, and the permeable layer 10 may be used in combination with a suitable substrate 12, if necessary. In an example shown in FIGS. 1 to 3, and FIGS. 5 and 7, the permeable layer 10 is formed on the surface of the substrate 12 and is supported by the substrate 12. As a result, it is easy to handle the permeable layer 10. The shape of the substrate 12 is for example a sheet shape, a film shape or the like. Examples of the substrate 12 include paper, plastic films and the like. The thickness and size of the substrate 12 are not particularly limited. In a case where the substrate 12 is used, the permeable layer 10 may be formed on the entire surface of the substrate 12 or on a part of the substrate 12.

The mean particle diameter based on volume (hereinafter, referred to as "mean particle diameter") of inorganic particles constituting the porous layer of the permeable layer 10 is preferably 3 nm to 100 nm. In this case, the surface evenness of the permeable layer 10 is superior and good gloss or shine can be thus imparted to images formed on a medium to be transferred (for example, transferred medium 200) using a recorded material according to this exemplary embodiment. In addition, when good matte gloss is imparted to the image on the transfer medium, the mean particle diameter of the inorganic particles of the permeable layer 10 may increase. In this case, the mean particle diameter of inorganic particles of the permeable layer 10 is for example higher than 100 nm and is lower than or equal to 300 nm.

At least a part of the dispersion medium 21 contained in an ink 20 mentioned below permeates into the permeable layer 10. The permeable layer 10 includes a porous layer having a mean hole diameter which almost does not accept the pigment 22 contained in the ink 20 or accepts little of the same, as described in the paragraph of "2. Method for forming image" of the specification. This property enables the dispersion medium 21 to mainly permeate into the permeable layer 10 and the pigment layer 30, in which the pigment 22 contained in the ink 20 is thickened, to be formed on the surface of the permeable layer 10, when the ink 20 is applied to the permeable layer 10.

In addition, one function of the permeable layer 10 is to control evenness of the surface of the pigment layer 30 which contacts the permeable layer 10. That is, the permeable layer 10 serves as filter paper having controlled surface evenness. As a result, the surface evenness of the pigment layer 30 which contacts the permeable layer 10 is controlled based on the surface evenness of the permeable layer 10. Also, when the pigment layer 30 is separated from the permeable layer 10 and is then transferred to a transfer medium, the desired gloss or shine can be imparted to the surface of the pigment layer 30.

For example, in a case where the pigment 22 contained in the ink 20 is glitter, as the surface evenness of the permeable layer 20 increases, mirror glossiness of the obtained image (for example, see Japanese Industrial Standards (JIS) Z8741) increases. Also, in this case, for example, as the roughness of the permeable layer 20 increases, mirror glossiness of the obtained image decreases and matte photoluminescence can be thus obtained. For example, when the pigment 22 contained in the ink 20 is glitter, the mean particle diameter of inorganic particles of the permeable layer 10 which can impart good photoluminescence to images formed on the transfer medium through the pigment layer 30 is preferably 3 nm to 300 nm.

Also, the mean particle diameter of the pigment is not particularly limited and is preferably 3 nm to 200 nm, more preferably, 3 nm to 80 nm, in terms of ejection efficiency from an ejection head (formed by an ink jet method). The permeable layer 10 according to the invention enables formation of pigment layer 30 in which a dispersion medium permeates into the permeable layer 10 and is thus thickened, and this dense pigment layer 30 enables realization of good shine or gloss. Also, when the pigment is glitter, considerable evenness is required to impart glossiness to the pigment layer 30. The use of permeable layer 10 is preferred in terms of dense arrangement of the pigment. In a case where the pigment is glitter, the pigment is different from a leaf-shaped glitter pigment and should be further densely arranged, since the mean particle diameter thereof falls within this range. Accordingly, the permeable layer 10 accomplishes the desired operation.

Examples of the material for the permeable layer 10 include metal oxides such as silica, alumina, titania and zinc oxide, metal silicates such as aluminum silicate, metal carbonates such as magnesium carbonate, talc and clay minerals such as a variety of clays. In addition, the material for the permeable layer 10 may comprise a binder, as necessary. For example, the binder may be at least one selected from vinylpyrrolidone resins such as polyvinylpyrrolidone and vinylpyrrolidone-vinyl acetate copolymers; polyvinyl alcohol resins such as polyvinyl alcohol, anion-modified polyvinyl alcohol, cation-modified polyvinyl alcohol and polyvinyl butyral; cellulose resins such as hydroxyethyl cellulose and hydroxy propyl cellulose; synthetic resins such as polyvinyl acetal, polyurethane, carboxymethyl cellulose, polyester, polyacrylic acid or ester thereof, polyacrylamide, melamine resins, styrene-butadiene resins, or modified substances thereof, and natural resins such as albumin, gelatin, casein, starch, cationic starch, gum arabic and sodium alginate or modified substances thereof.

In addition, when the substrate 12 is used, the permeable layer 10 may be formed by subjecting the substrate 12 to coating or the like. In this case, for example, the desired surface shape can be formed by pressing or the like. In addition, commercially available products in which the permeable layer 10 is formed on the substrate 12 may be used.

The material for the substrate 12 is not particularly limited and examples thereof include a variety of paper, fabrics, films, sheets and the like. Examples of commercially available products in which the permeable layer 10 is formed on the substrate 12 include surface-processed paper such as coated paper, art paper and cast coated paper, and products in which an ink accepting layer is formed on the surface of a vinyl chloride sheet or a plastic film such as a PET film.

Examples of coated paper include paper in which the permeable layer 30 is coated at 7 $g/m^2$ to 20 $g/m^2$ on at least one surface of high-quality paper or medium-quality paper as a base. Such paper may be often called "high-quality coated paper" or "medium-quality coated paper". In addition, the type of coated paper may be light-weight coated paper or matte coated paper, miller coated paper in which the amount of the permeable layer 30 coated is low (for example, about 7 $g/m^2$ on one surface).

Examples of art paper include paper in which the permeable layer 30 is coated at about 20 $g/m^2$ (per surface) on high-quality paper and the surface of the permeable layer 30 is evened by applying a pressure thereto by a roller or the like. The art paper includes shine-free art paper, high-quality art paper, general art paper and the like. Examples of cast coated paper include paper in which the permeable layer 30 is coated at 22 g/m$^2$ or more (per surface) on high-quality paper and the surface of the permeable layer 30 is evened by applying a pressure thereto by a roller or the like.

Specifically, examples of commercially available products in which the permeable layer 10 is formed on the substrate 12 include pearl coated paper (manufactured by Mitsubishi Paper Co., Ltd.), aurora coated paper (manufactured by Nippon Paper Industries Co., Ltd.), photo paper chrisphere (manufactured by Seiko Epson Corporation), photo paper <gloss> (manufactured by Seiko Epson Corporation), photo paper entry (manufactured by Seiko Epson Corporation), photo gloss paper (manufactured by Seiko Epson Corporation) and the like.

1.1. Pigment Layer

The pigment layer 30 is formed on the permeable layer 10. The pigment layer 30 is formed on the permeable layer 10 by adhering an ink 20 containing a pigment 22 to the permeable layer and allowing at least a part of the dispersion medium 21 of the ink 20 to permeate into the permeable layer 10. The flat shape and thickness of the pigment layer 30 are not particularly limited. The pigment layer 30 may be formed on the entire surface of the permeable layer 10 or on a part of the permeable layer 10. When the pigment layer 30 is transferred from the transfer member 100 to a transfer medium (for example, transferred medium 200), the pigment layer 30 becomes an image on the transfer medium.

The ink 20 contains at least a pigment 22 and a dispersion medium 21 of the pigment 22 (such as water, organic solvent, and additives), although the details thereof will be described below. Accordingly, when the ink 20 is applied to the permeable layer 10, at least a part of the dispersion medium 21 permeates into the permeable layer 10 and a region in which the pigment 22 is thickened is formed on the surface of the permeable layer 10 due to the aforementioned performance of the permeable layer 10. As a result, the pigment layer 30 is formed on the surface of the permeable layer 10, in which the pigment layer 30 contains the pigment 22 in a greater amount than the content of the pigment 22 in the ink 20. That is, the pigment layer 30 is formed when the permeable layer 10 absorbs the dispersion medium 21 of the ink 20 and the permeable layer 10 does not accept or accepts little of the pigment 22 of the ink 20.

The pigment layer 30 is formed on the permeable layer 10 and has the same evenness as the surface evenness of the permeable layer 10. Accordingly, the surface evenness of the pigment layer 30 is controlled and the desired gloss or shine can be imparted to the surface of the pigment layer 30 (the surface which contacts the permeable layer 10). In particular, when the pigment 22 contained in the pigment layer 30 is a glitter pigment (for example, a powder of an alloy of one or more selected from the group consisting of aluminum, silver, gold, platinum, nickel, chromium, tin, zinc, indium, titanium and copper), the desired glitter images can be formed. When the material for the pigment layer 30 contains the pigment 22 dispersed in the ink 20, it may further contain components (for example, dispersion medium 21, additives or the like) other than the pigment 22.

1.2. Adhesive Layer

The adhesive layer 40 is formed on at least the pigment layer 30. The adhesive layer 40 may be formed on the permeable layer 10 as well as on the pigment layer 30, as shown in FIG. 2. The thickness of adhesive layer 40 is not particularly limited and is for example 0.2 μm to 5 μm. The thickness of the adhesive layer 40 may be suitably determined depending on the characteristics of a transfer medium (for example, transferred medium 200) of the pigment layer 30. For example, when the surface roughness of the transfer medium is high, the thickness of the adhesive layer 40 may be suitably determined so that the roughness has no effect on the surface of the pigment layer 30 (the surface which contacts the permeable layer 10 before transfer). In addition, in a case where the transfer medium has permeability, the thickness may be determined taking into consideration the permeability (see FIG. 5).

The adhesive layer 40 has adhesivity. The term "adhesivity" used herein refers to a property in which the pigment layer 30 is adhered to the transfer medium. The adhesivity may be represented by the adhesive layer 40 in itself or may be represented, when at least one stimulus such as pressure, temperature (heat) and radiation (such as light) is applied to the adhesive layer 40.

One function of the adhesive layer 40 is to adhere the pigment layer 30 to the transfer medium. Owing to this performance, the pigment layer 30 contained in the transfer member 100 according to this exemplary embodiment can be transferred to the transfer medium.

The adhesivity level of the adhesive layer 40 is sufficient, if an adhesion strength between the pigment layer 30 and the transfer medium (for example, transferred medium 200) through the adhesive layer 40 is higher than an adhesion strength between the permeable layer 10 and the pigment layer 30. In addition, as shown from an example illustrated in FIG. 2, in a case where the adhesive layer 40 is formed on the permeable layer 10, the adhesivity level of the adhesive layer 40 is sufficient if the adhesion strength between the pigment layer 30 and the transfer medium through the adhesive layer 40 is higher than an adhesion strength between the permeable layer 10 and the pigment layer 30. That is, in the case of the example of FIG. 2, after the pigment layer 30 is transferred to the transfer medium, the adhesive layer 40 arranged on the permeable layer 10 may remain on the side of the permeable layer 10 or the side of the transfer medium.

Examples of the material for the adhesive layer 40 include monomers, oligomers and resins generally used for adhesives such as acryl, urethane, vinyl chloride and vinyl acetate. In this case, the material may optionally contain an additive such as a polymerization initiator, a reaction aid and a filler. In addition, examples of the material for the adhesive layer 40 include thermoplastic resins such as polyolefins, polyamides and derivatives thereof. In this case, the material may optionally contain an additive such as anti-oxidants, UV absorbers and fillers. In addition, examples of the material for the adhesive layer 40 include adhesive materials including natural resins such as rosin, pre-gelatinized starch, a glue and a variety of saccharides or derivatives thereof. In addition, the material for the adhesive layer 40 may be a pressure-sensitive adhesive. Examples of the pressure-sensitive adhesive include adhesives in which an adhesive is sealed in a fine capsule. The material for the adhesive layer 40 may be a mixture of two or more of the aforementioned materials. In addition, the capability of improving the film strength of the pigment layer 30 can be imparted to the adhesive layer 40. In this case, the material for the adhesive layer 40 may contain a compound serving as a binder of the pigment 22. Examples of the compound serving as a binder of the pigment 22 include styrene butadiene resins, cellulose resins, acrylic resins, urethane resins, and derivatives thereof. In addition, the adhesive layer 40 may be colored with a variety of colorings such as dyes and pigments.

1.3. Action and Effects

According to the transfer member 100 of this exemplary embodiment, images with good gloss or shine can be easily formed on the medium regardless of the type of the transfer medium. That is, the transfer member 100 according to this exemplary embodiment can perform transfer by adhering the pigment layer 30 having the surface corresponding to the surface evenness of the permeable layer 10 to the transfer medium through the adhesive layer 40. As a result, images with good gloss or shine can be easily formed on the transfer medium. In particular, when the pigment layer 30 is a glitter layer (glitter pigment layer), the surface of the glitter layer has the same evenness as the permeable layer 10 since it corresponds to the even surface of the permeable layer 10, and the particles of the pigment 22 substantially uniformly reflect irradiated light, since the particles of the pigment 22 are densely arranged. As a result, a transferred member which can transfer images with superior glossiness to any transferred medium can be formed. That is, regardless of the type of the transfer medium, images with good gloss or shine can be easily formed on the transferred medium.

With known screen printing and ink jet printing methods, it is difficult to control surface evenness of images. That is, in spite of printing using an ink exhibiting gloss, there are cases in which surface evenness cannot be secured and images with the desired gloss or shine cannot be obtained. For this reason, in the art, for example, in the process of recording glossy or shiny images on a recording medium, the type of recording medium is limited and in some cases, images require surface flattening.

In this regard, according to a recorded material of the exemplary embodiment, regardless of the type (characteristics) of the transfer medium, glossy or shiny images with even surface can be considerably easily formed on the medium. In particular, in a case where the transfer medium is general paper, film or the like, the effects of the recorded material of this exemplary embodiment can be considerably improved and glossy or shiny images can be considerably easily recorded on a medium such as general paper or film which is not easily formed by common methods.

In addition, the transferred medium 200 may have a surface exhibiting a release property. That is, the transferred medium 200 is not limited to a subject to be transferred. In this case, although the transferred medium 200 is adhered to the pigment layer 30 through the adhesive layer 40, and the adhesion strength of the corresponding adhesion is lower than the adhesion strength between the permeable layer 10 and the pigment layer 30. Accordingly, in the case where the transferred medium 200 has a release property, the transfer member 100 can separate the interface between the transferred medium 200 and the adhesive layer 40 at a predetermined timing. In addition, the pigment layer 30 can be transferred to another transfer medium through the adhesive layer 40 exposed when the transferred medium 200 is peeled off. According to the transfer member 100 of this embodiment, since formation of scratch marks by transport or the like can be inhibited and the transfer member 100 contacts a desired transfer medium at a predetermined point of time a user desires and the permeable layer 10 is separated from the pigment layer 30 to perform transfer, and images with good gloss or shine can be thus formed on the desired transfer medium at the desired timing.

1.4. Modified Exemplary Embodiment

Figure 3:
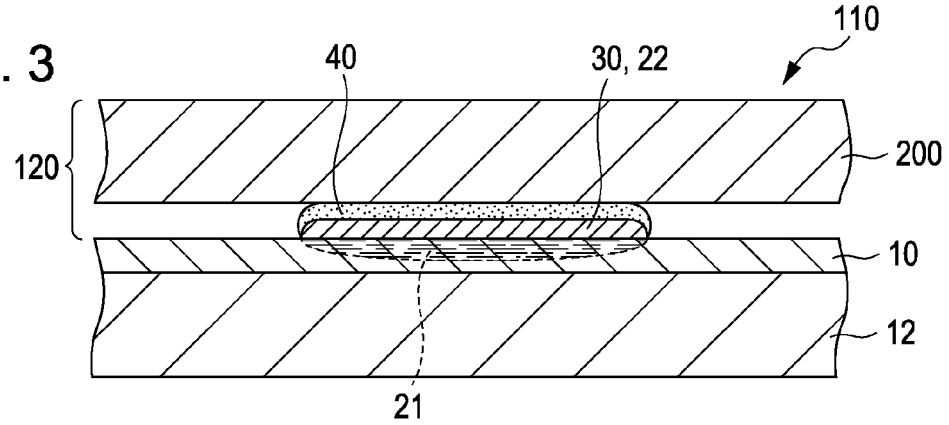
FIG. 3 is a schematic cross-sectional view illustrating a recording material according to an exemplary embodiment.
Figure 4:
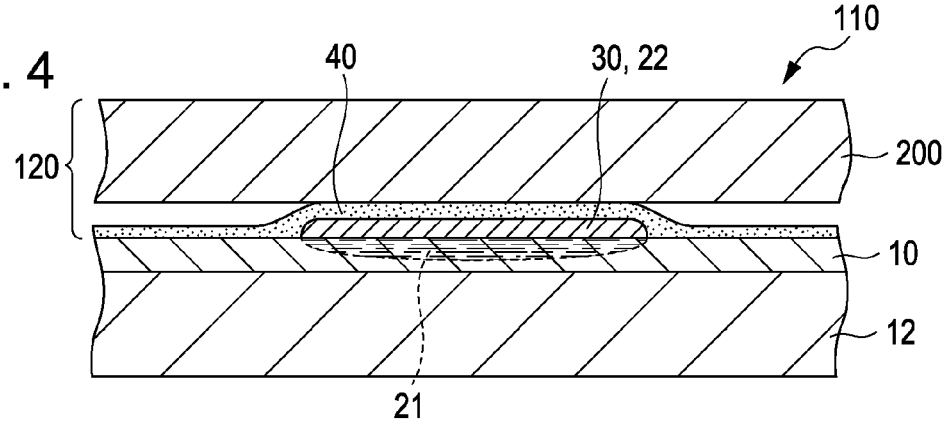
FIG. 4 is a schematic cross-sectional view illustrating a recording material according to an exemplary embodiment.
Figure 5:
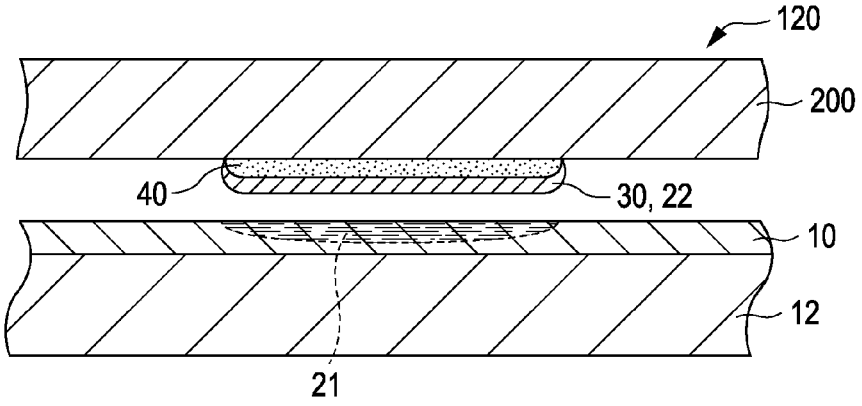
FIG. 5 is a schematic cross-sectional view illustrating a recording material according to an exemplary embodiment.
Figure 6:
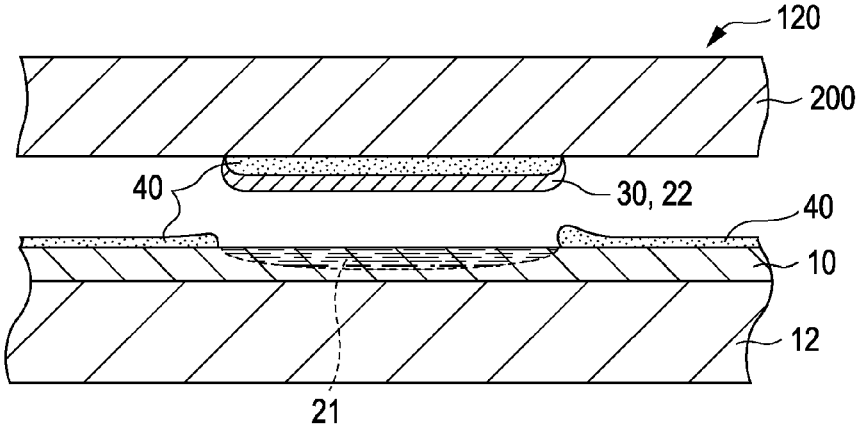
FIG. 6 is a schematic cross-sectional view illustrating a recording material according to an exemplary embodiment.

FIGS. 3 and 4 are schematic cross-sectional views illustrating a transfer member 110 according this exemplary embodiment. FIGS. 5 and 6 are schematic cross-sectional views illustrating a transferred member 120 according to this exemplary embodiment.

In the transfer member 110 of the modified exemplary embodiment, a transferred medium 200 is disposed with respect to the adhesive layer 40 of the transfer member 100 described above. In addition, the pigment layer 30 is adhered to the transferred medium 200 through the adhesive layer 40.

The transferred medium 200 is not particularly limited. Examples of the transferred medium 200 include a variety of paper, fabrics, films, sheets and the like. More specifically, examples thereof include paper described in Japanese Industrial Standards JIS-P0001, fabrics described in JIS-L0206, non-woven fabrics described in JIS-L0222, and films or sheets composed of materials such as polyethylene terephthalate (PET), polybutylene terephthalate (PBT), polycarbonate, polyethylene naphthalate, polyester, polyethylene, polypropylene, acrylic resins, polystyrene, polyvinyl chloride, polyvinyl acetate, polyvinyl alcohol, polyether ether ketone, polyamide, polyethersulfone, polydiacetate, triacetate, polyimide, woods, metals, ceramics and glasses. In addition, the transferred medium 200 may be coated paper such as coated paper or art paper.

Figure 7:
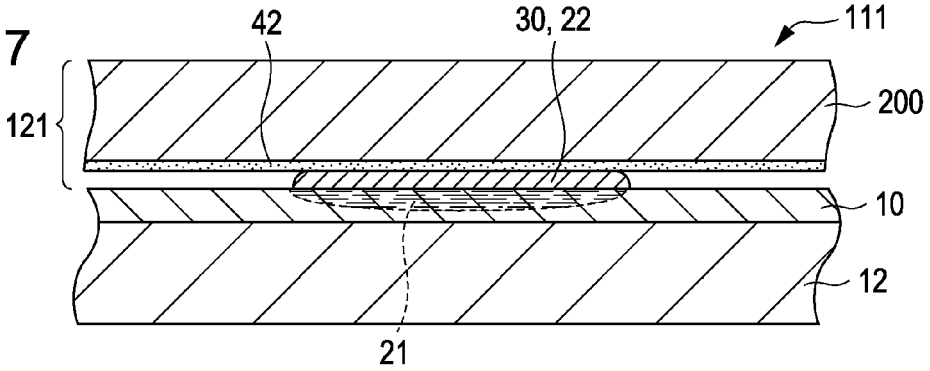
FIG. 7 is a schematic cross-sectional view illustrating a recording material according to an exemplary embodiment.

The transfer member 110 has a structure in which the transfer member 100 according to the exemplary embodiment is integrated with a transferred medium 200. The permeable layer 10 of the transfer member 110 illustrated in FIGS. 3 and 7 is formed on the substrate 12. The transfer member 110 enables easy separation between the permeable layer 10 and the pigment layer 30. As shown in FIGS. 5 and 6, when the interface between the permeable layer 10 and the pigment layer 30 of the transfer member 110 is peeled off, a transferred member 120 in which an adhesive layer 40 and a pigment layer 30 are laminated on the transferred medium 200 in this order can be obtained. The transferred member 120 is provided with the pigment layer 30 having a surface with a controlled evenness (the surface opposite to the adhesive layer 40) and an image formed by the pigment layer 30 exhibits good gloss or shine.

In addition, in an example of the transfer member 110 shown in FIG. 3, the pigment layer 30 and the adhesive layer 40 have an identical flat surface. Meanwhile, in an example of the transfer member 110 shown in FIG. 4, the adhesive layer 40 has a flat surface larger than the pigment layer 30. As shown in FIG. 6, when the adhesive layer 40 has a flat surface larger than the pigment layer 30, for example, only a part of the adhesive layer 40 to adhere the pigment layer 30 may be transferred to the transferred medium 200. In addition, although not shown, when the adhesive layer 40 having a larger flat surface than the pigment layer 30 is formed, the pigment layer 30 and the adhesive layer 40 may be transferred to the transferred medium 200.

Figure 8:
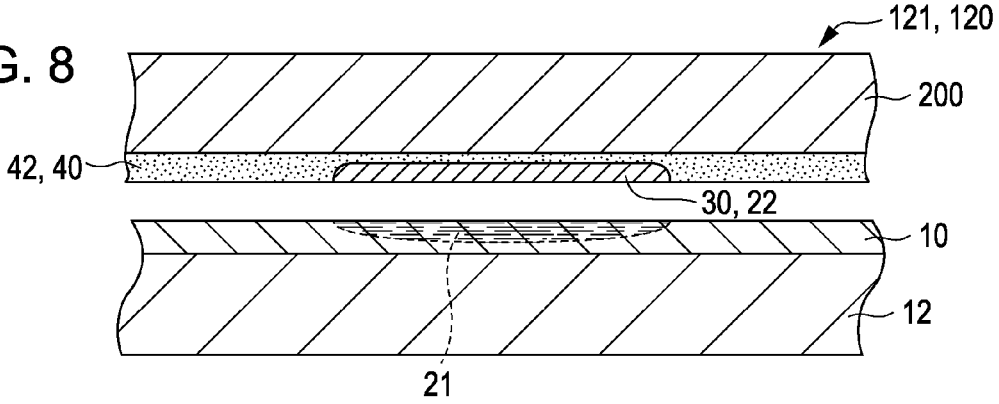
FIG. 8 is a schematic cross-sectional view illustrating a recording material according to an exemplary embodiment.

FIG. 7 is a schematic cross-sectional view illustrating a transfer member 111 according to another modified exemplary embodiment. FIG. 8 is a schematic cross-sectional view illustrating a transferred member 121 according to another modified exemplary embodiment.

The transfer member 111 according to the modified exemplary embodiment is different from the transfer member 110 in that the adhesive layer 42 is formed on the transferred medium 200. In the transfer member 111, the pigment layer 30 is formed on the permeable layer 10 and the adhesive layer 40 is not formed on the pigment layer 30. That is, the adhesive layer 42 is formed on the medium to be transferred (transferred medium 200) and the transferred medium 200 is adhered to the pigment layer 30 through the adhesive layer 42.

In the transferred member 121 according to another modified exemplary embodiment, as shown in FIG. 8, the surface of the pigment layer 30 and the surface of adhesive layer 40 have a common flat surface. The transferred member 121 may be for example formed by applying a pressure or heat to the transfer member 110 shown in FIG. 4 or the transfer member 111 shown in FIG. 7 such that the permeable layer 10 and the transferred medium 200 are pressed and thereby deforming an adhesive layer 40 or an adhesive layer 42.

In the transfer member 110 or transfer member 111 according to the modified exemplary embodiment, the transferred member 120 or transferred member 121 having images with good gloss or shine can be easily transferred to a transferred medium 200. In addition, according to the transfer member 110 or transfer member 111 of the modified exemplary embodiment, the permeable layer protects the surface of images formed on the transferred member 120 or transferred member 121 and can thus suppress formation of scratch marks due to transport or the like. In addition, according to the transfer member 110 or transfer member 111, a user can separate the permeable layer 10 from the pigment layer 30 at a desired point of time and the transferred member 120 or transferred member 121 provided with images with good gloss or shine can be obtained at the desired timing.

2. Image Formation Method

FIGS. 9 to 12 are schematic views illustrating a process of an image formation method according to one exemplary embodiment of the invention.

The image formation method according to this exemplary embodiment includes forming a pigment layer 30, forming an adhesive layer 40 and adhering the pigment layer 30 to a transferred medium 200.

2.1. Process for Forming Pigment Layer

Figure 9:
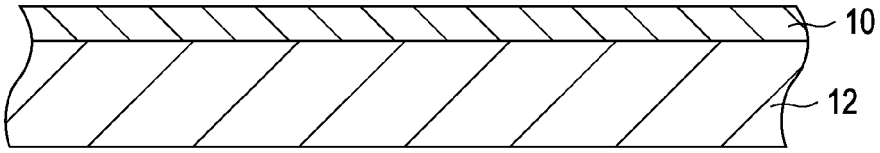
FIG. 9 is a schematic view illustrating a process of an image formation method according to an exemplary embodiment.
Figure 10:
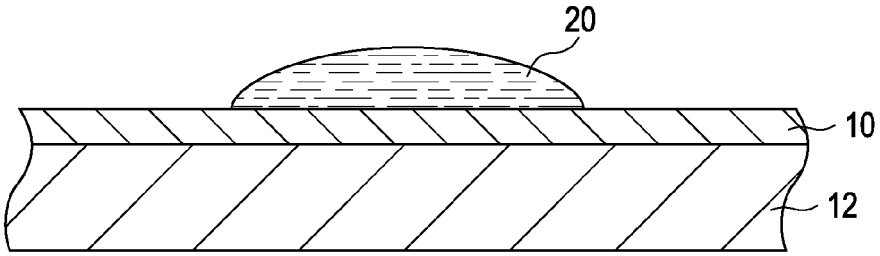
FIG. 10 is a schematic view illustrating a process of an image formation method according to an exemplary embodiment.
Figure 11:
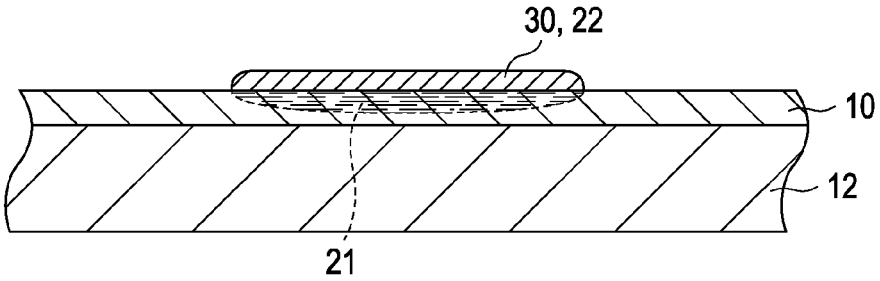
FIG. 11 is a schematic view illustrating a process of an image formation method according to an exemplary embodiment.

FIGS. 9 to 11 are schematic views illustrating a process for forming a pigment layer 30.

2.1.1. Formation of Pigment Layer

First, a permeable layer 10 is prepared. As shown in FIG. 9, the permeable layer 10 may be formed on the substrate 12. Then, as shown in FIG. 10, an ink 20 is adhered to the permeable layer 10. The method for adhering the ink 20 to the permeable layer 10 is not particularly limited and examples thereof include ink jet methods, dipping methods (including coating using a brush, a squeegee or the like), bar coating methods, stencil printing methods (screen printing), anastatic printing methods and intaglio printing methods. Of these methods, the ink jet method is more preferred in that it requires no process for preparing a plate and enables easy formation of the desired image, thus reducing waste of the ink 20.

When the ink 20 is adhered to the permeable layer 10, as shown in FIG. 11, at least a part of the dispersion medium 21 of the ink 20 permeates into the permeable layer 10. The permeable layer 10 can absorb the dispersion medium 21 contained in the ink 20, as mentioned above. In addition, the permeable layer 10 is selected from those having a mean hole diameter which does not accept or barely accepts the pigment 22 contained in the ink 20. From this viewpoint, a porosity of the permeable layer 10 is for example 40% to 80%. As a result, regarding the ink 20 adhered to the permeable layer 10, based on the surface of the permeable layer 10, at least a part of the dispersion medium 21 permeates into the permeable layer 10 and the pigment 22 is thickened over the surface of the permeable layer 10. Accordingly, the pigment layer 30 is formed with respect to the permeable layer 10.

In addition, in this process, when the ink 20 is adhered to the permeable layer 10, evenness of the surface of the pigment layer 30 which contacts the permeable layer 10 corresponds to surface evenness of the permeable layer 10. That is, the permeable layer 10 serves as filter paper with controlled surface evenness. As a result, the surface of the pigment layer 30 which contacts the permeable layer 10 is controlled based on the surface evenness of the permeable layer 10 and the pigment 22 is densely arranged in the pigment layer 30.

2.1.2. Ink

The ink 20 used for the process of forming the pigment layer 30 at least contains a pigment 22 and a dispersion medium 21.

2.1.2.1. Pigment

The pigment 22 is not particularly limited and examples thereof include a variety of known pigments such as inorganic pigments, organic pigments and specific (white, metal or pearl) pigments.

Examples of yellow pigments include C.I. pigment yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172 and 180.

Examples of magenta pigments include C.I. pigment red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, and C.I. pigment violet 19, 23, 32, 33, 36, 38, 43 and 50.

Examples of cyan pigments include C.I. pigment blue 1, 2, 3, 15, 15:1, 15:2, 15:3, 15:4, 15:6, 15:34, 16, 18, 22, 25, 60, 65 and 66, and C.I. vat blue 4 and 60.

In addition to magenta, cyan and yellow, examples of color pigments include C.I. pigment green 7, 10, C.I. pigment brown 3, 5, 25, 26, and C.I. pigment orange 2, 5, 7, 13, 14, 15, 16, 24, 34, 36, 38, 40, 43 and 63.

Examples of black pigments include carbon black such as furnace black, lamp black, acetylene black and channel black (C.I. pigment black 7) and powders such as iron oxide.

Examples of white pigments include titanium oxide, porous particles composed of organic or inorganic materials and powders such as calcium carbonate, zinc oxide, silicon oxide, and aluminum oxide. In addition, examples of pearl pigments include clay minerals.

Any metal pigment may be used without particular limitation as long as it exhibits photoluminescence when adhered to a medium and examples thereof include alloys of one or more selected from the group consisting of aluminum, silver, gold, platinum, nickel, chromium, tin, zinc, indium, titanium and copper, and pearl pigments with pearl gloss.

The pigment is preferably a metal pigment. A combination of the transfer medium having the permeable layer according to the invention and a glitter pigment exhibits superior effects.

The ink 20 may contain a plurality of the pigments 22.

The methods for dispersing the pigment in a dispersion medium include various methods such as resin dispersion, self-dispersion and microcapsule dispersion (one type of resin dispersion in the present specification, in which microencapsulation is performed by a resin) and is preferably a dispersion method other than resin dispersion in this exemplary embodiment (including micro-capsulation dispersion). In particular, color pigments are preferably self-dispersing pigments. Self-dispersing pigments are pigments having dispersible functional groups, and have a surface containing little or no resin, polymer or the like and are thus preferred from a viewpoint of transferring to a recording medium at low adhesion. The resin dispersion and micro-capsule dispersion (micro-capsule dispersion is a type of resin dispersion) are not preferred in the invention in that the resin coated on the pigment exhibits a strong adhesion property.

Examples of resins used for resin dispersion and micro-capsule dispersion include polyvinyl resins such as vinyl chloride, vinyl acetate, polyvinyl alcohol, polyvinyl butyral, polyester resins such as alkyd resins, phthalic acid resins, amino materials such as melamine resins, melamine formaldehyde resins, amino alkyd polycondensed resins, urea resins and urea melamine formaldehyde resins; materials having anionic groups such as thermoplastic, thermosetting or modified acrylic resins, epoxy resins, polyurethane resins, polyether resins, polyamide resins, unsaturated polyester resins, phenol resins, silicone resins, fluorine polymer compounds, or copolymers or mixtures thereof.

The self-dispersing pigment has a surface provided with a hydrophilic group. The hydrophilic functional group is not particularly limited as long as it is a functional group exhibiting hydrophilicity. The hydrophilic functional group is preferably at least one selected from a sulfonic acid group, a carboxylic group and a hydroxyl group. More preferred are a carboxylic group and a hydroxyl group. As a result, dispersion stability of pigment particles in an ink composition can be further improved.

In addition, such hydrophilic functional groups may be made to be present on the surface of pigment particles by electrically adhering a compound having the hydrophilic functional group to pigment particles, or may be directly chemically bonded to the surface of pigment particles. It is preferable that the hydrophilic functional groups are directly chemically bonded to the pigment particles. When the hydrophilic functional group is directly chemically bonded thereto, the water-soluble functional groups are not readily separated from the surface of pigment particles and dispersion stability of pigment particles in an ink composition can be thus improved.

The particle diameter of the pigment 22 allowing the pigment not to permeate or to not to easily permeate into the permeable layer 10 is selected taking into consideration characteristics of the porous layer of the permeable layer 10. For example, the particle diameter (mean particle diameter) of the pigment 22 is preferably 1 nm to 500 nm, more preferably 3 nm to 200 nm, most preferably, 3 nm to 200 nm. In addition, the mean particle diameter of the pigment 22 may be measured by obtaining a grain size accumulation curve through light (laser) scattering, nitrogen absorbance or the like. The content of the pigment 22 in the ink 20 according to this exemplary embodiment is for example preferably 1% by mass to 25% by mass, more preferably 3% by mass to 20% by mass, with respect to the total amount of the ink 20.

2.1.2.2. Dispersion Medium

The dispersion medium 21 used for the ink 20 is not particularly limited. Examples of the dispersion medium 21 include water, organic solvents, reactive compounds and mixtures thereof. The pigment 22 in the ink 20 is dispersed in the dispersion medium 21. In a case where a substance (for example, a compound to disperse the pigment 22) other than the pigment 22 is contained in the ink 20, when the substance is a liquid at room temperature, the compound may be also considered to be as a type of the dispersion medium 21.

2.1.2.3. Other Components

The ink 20 may contain a variety of known materials. For example, the ink 20 may contain surfactants, adhesive primers, wetting agents, permeation solvents, pH adjusters, antiseptic agents, fungicides, anti-oxidants, UV absorbers or the like. In addition, the ink 20 may optionally contain a leveling additive, a matte agent, a polyester resin to control film properties of the pigment layer 30, a polyurethane resin, a vinyl resin, an acrylic resin, a rubber resin or a wax. In addition, more preferably, the ink 20 is free of re-dispersion of the pigment 22, when it contacts a liquid for forming the adhesive layer 40. For example, re-dispersion can be suppressed by incorporating polyester resins, polyurethane resins, vinyl resins, acrylic resins, rubber resins or waxes in the ink.

2.2. Process for Forming Adhesive Layer

Next, as shown in FIGS. 1 and 2, an adhesive layer 40 is formed on at least the pigment layer 30. For example, the adhesive layer 40 is formed by applying a compound having adhesivity, or exerting adhesivity in response to a specific stimulus or a liquid containing the compound.

The compound having adhesivity is the same as described in the paragraph "1.3. Adhesive layer".

In the embodiment of FIG. 1, the adhesive layer 40 is formed on only the pigment layer 30. As shown in FIG. 2, in a case where the adhesive layer 40 is formed on the permeable layer 10, the material for the adhesive layer 40 is selected from those which enable easy separation between the transferred medium 200 and the permeable layer 10. In this case, the adhesive layer 40 formed in a region other than the pigment layer 30 may be present in any one of the permeable layer 30 and the transferred medium 200, as long as the pigment layer 30 is transferred to the transferred medium 200, when the permeable layer 10 is separated from the transferred medium 200.

The adhesive layer 40 may be formed by a variety of methods and examples thereof include ink jet methods, dipping methods (including coating using a brush, squeegee or the like), bar coating methods, stencil printing methods (screen printing methods), anastatic printing methods and intaglio printing methods. Of these methods, the ink jet method is more preferred in that it requires no process for preparing a plate and enables easy formation of the desired image, thus reducing waste of liquids to form the adhesive layer 40.

2.3. Process for Adhering Recording Medium to Pigment Layer

Figure 12:
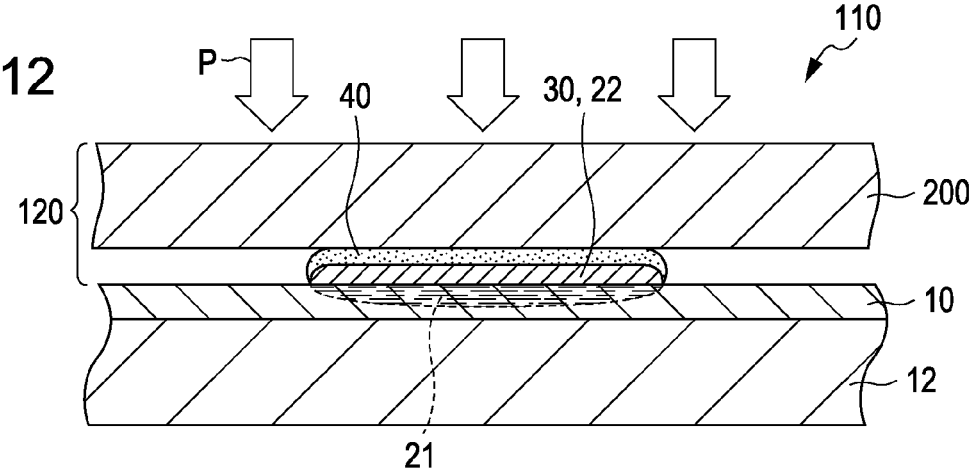
FIG. 12 is a schematic view illustrating a process of an image formation method according to an exemplary embodiment.

Then, as shown in FIG. 12, a transferred medium 200 is arranged on the adhesive layer 40 and the transferred medium 200 is adhered to the pigment layer 30. This process is suitably carried out depending on the material for the adhesive layer 40. For example, in a case where the adhesive layer 40 has sufficient adhesivity at room temperature, the transferred medium 200 can be adhered to the pigment layer 30 by arranging the transferred medium 200 on the adhesive layer 40 and applying a low pressure P thereto. In this case, pressing, roller pressing or the like may be performed, as necessary. In addition, in a case where the adhesive layer 40 exhibits adhesivity when heat is applied thereto, the adhesion may be carried out by heating at least one of the transferred medium 200 and a substrate 12 (permeable layer 10) using a suitable heating equipment. In addition, in a case where the adhesive layer 40 exhibits adhesivity when a pressure is applied thereto, for example, the pressure P is applied thereto by roller pressing, pressing or manual operation using a jig or the like. In addition, in a case where the adhesive layer 40 exhibits adhesivity when heat is applied thereto, this process may be carried out by heating, or may be carried out by heating in combination with roller pressing, pressing or the like.

For example, when the adhesive layer 40 is an adhesive containing a thermosetting compound, in this process, the adhesive layer 40 is preferably heated to a temperature higher than a polymerization temperature of the adhesive (for example, activation temperature of polymerization initiator). In addition, for example, when the adhesive layer 40 is composed of an adhesive containing a thermoplastic polymer in this process, the adhesive layer 40 is preferably heated to about at least one of the glass transition temperature (Tg) and the melting point (Tm) of the thermoplastic polymer, more preferably heated to a temperature higher than the Tm.

2.4. Modified Exemplary Embodiment

The image formation method of the exemplary embodiment may include preparing a transferred medium 200 provided with an adhesive layer 42 having adhesivity, instead of the process for forming the adhesive layer.

In the image formation method of the exemplary embodiment, a transfer member (side of permeable layer) adhesive layer 40 is formed and a pigment layer 30 is adhered to a transferred medium 200 using the adhesive layer 40. However, like this modified exemplary embodiment, the case where the adhesive layer is formed on the transferred medium 200 also exhibits identical results.

In the image formation method according to this modified exemplary embodiment, the adhesive layer 42 is formed on the transferred medium 200. Specifically, the adhesive layer 42 is formed on one surface of the transferred medium 200. The adhesive layer 42 may be formed over the entire surface of the recording medium 20 or with a size of a region including a reverse shape of the pigment layer 30 adhered to the permeable layer 10. When the adhesive layer 42 is formed with the same size as the reverse shape of the pigment layer 30 adhered to the permeable layer 10 on a recording medium 20, the amount of a liquid for forming the ink 20 and the adhesive layer 42 can be minimized.

In addition, in this modified exemplary embodiment, the transferred medium 200 can be adhered to the pigment layer 30 through the adhesive layer 42 in the same manner as in "2.3. Process for adhering recording medium to pigment layer".

2.5. Action and Effects

According to the image formation method of this exemplary embodiment, for example, a recorded material of the aforementioned exemplary embodiment can be easily obtained. According to the image formation method of this exemplary embodiment, images with good gloss or shine can be easily formed on the recording medium, regardless of the type of recording medium.

2.6. Process for Transferring Pigment Layer

The image formation method of this exemplary embodiment may include transferring the pigment layer 30 from the permeable layer 10 to the transferred medium 200.

The pigment layer 30 is adhered to the transferred medium 200 through the image formation method of the exemplary embodiment. For example, this process, as shown in FIGS. 5, 6 and 8, is a process for peeling off the interface between the permeable layer 10 and the pigment layer 30. Through this process, the pigment layer 30 is transferred to the transferred medium 200 to obtain a transferred member 120 or a transferred member 121.

A specific method of this process may be carried out using a general filler or the like without particular limitation. In addition, this process may be carried out by suitably arranging a roller or the like and transporting the transferred medium 200 or the permeable layer 10. In addition, this process may be for example carried out by the hand of a user.

In a case where the adhesive layer 40 contains a thermoplastic compound, this process may be preferably carried out after cooling the adhesive layer 40, after "2.3. Process for adhering recording medium to pigment layer". In this case, for example, after the process for adhering the recording medium to the pigment layer, the cooling process may be performed. Examples of the cooling process include setting a cooling period of time or cooling the adhesive layer 40 using cooling equipment (such as a cooling roller).

In a case where transfer is carried out by application of heat, a heating roller, a platen heater, or a beam of light to generate radiative heat may be used. For example, manual transfer may be carried out using a heater such as an iron.

When the image formation method of this exemplary embodiment includes transferring the pigment layer 30 from the permeable layer 10 to the transferred medium 200, for example, the transferred member 120 and the transferred member 121 of this exemplary embodiment can be considerably easily obtained. In addition, regardless of the type of the transferred medium, images with good gloss or shine can be easily formed on the transferred medium 200.

As described above, according to this exemplary embodiment, regardless of the type of the transferred medium, a glitter layer 30 is transferred to the medium and images with excellent glossiness can be formed on the transferred medium. Accordingly, images with excellent glossiness can be formed on even transferred media according to the related art having no ink-absorbency or low ink-absorbency, or transferred media having a rough surface having the risk of deterioration in image qualities of glossy images, and remarkable effects can be thus obtained.

The term "transferred medium having no ink-absorbency or low ink-absorbency" used herein refers to a transferred medium which has no ink accepting layer, or lacks an ink accepting layer. More quantitatively, the transferred medium having no ink-absorbency or low ink-absorbency means a transferred medium whose recording surface absorbs water of 10 $mL/m^2$ or less from contact initiation to 30 $msec^{1/2}$, in accordance with Bristow's method. This Bristow's method is the most general method for measuring an absorbed liquid amount for a short period of time and is also adopted by the Japan Technical Association of the Pulp and Paper Industry (JAPAN TAPPI). Details of the test method are described in "JAPAN TAPPI paper and pulp test method, 2000" Vol. No. 51 "Paper and paperboard-liquid absorbance, Bristow's Method".

Examples of the transferred medium having no ink-absorbency include materials in which a plastic is coated on a substrate for ink jet recording such as plastic films or paper which are not surface-treated (that is, they have no ink accepting layer) and materials in which a plastic film is adhered to the substrate. Examples of the plastic include polyvinyl chloride, polyethylene terephthalate, polycarbonate, polystyrene, polyurethane, polyethylene polypropylene and the like.

The transferred medium having low ink-absorbency may be coated paper and examples thereof include recording-base paper (printing-based paper) such as slightly-coated paper, art paper, coated paper, matte paper and cast paper. Coated paper is a paper whose surface is coated with a coating material to improve an aesthetic sense or evenness. The coating material may be prepared by mixing pigments such as talc, pyrophyllite, clay (kaolin), titanium oxide, magnesium carbonate, calcium carbonate, with an adhesive agent such as starch. The coating material is coated using a so-called "coater" machine in the process of manufacturing paper. Coaters are divided into on-machine coaters directly connected to a paper machine to perform papermaking and coating in one step and off-machine coaters in which papermaking is performed in a separate process. Coaters are mainly used for recording and are classified by coated paper for printing in "Production dynamics statistics" by the Ministry of Economy, Trade and Industry. The term "slightly-coated paper" refers to recording paper coated with 12 g/m$^2$ or less of a coating material. The term "art paper" refers to recording paper in which a high-quality recording paper (high-quality paper, chemical pulp usage percentage of 100%) is coated with about 40 g/m$^2$ of a coating. The term "coated paper" refers to recording paper coated with about 20 g/m$^2$ to about 40 g/m$^2$ of a coating. The term "cast paper" refers to recording paper in which a pressure is applied to the surface of art paper or coated paper using a so-called "cast drum" machine to subject the paper to finishing and thereby improve gloss or recording effects. In addition, the term "coating amount" means a total amount of coating present on both surfaces of recording paper.

The transferred medium having a rough surface refers to a transferred medium which includes a rough surface having an arithmetical mean roughness (Ra) of 20 μm or more. The arithmetical mean roughness (Ra) may be for example measured by obtaining the sum of surface roughness or using an optical microscope. Examples of the surface roughness meters include a step surface roughness micro form meter, P-15 (manufactured by KLA-Tencor Corporation). Examples of the transferred medium having a rough surface include high-quality paper 55 PW8R, XeroxP (manufactured by Fuji Xerox. Co., ltd.; arithmetical mean roughness (Ra)=29.2 μm), plain and design paper black paper (manufactured by Tochiman Technical Paper Co., Ltd.; arithmetical mean roughness (Ra)=30.2 μm), Super Fine Paper (manufactured by Seiko Epson Corp.; arithmetical mean roughness (Ra)=36.6 μm), B flute corrugated sheet (manufactured by Rengo Co., Ltd.; arithmetical mean roughness (Ra)=39.9 μm) and the like. In addition, examples of transferred media having a rough surface include linen and silk.

Second Exemplary Embodiment

Next, a second exemplary embodiment will be described.

3. Transfer Member

Figure 13:
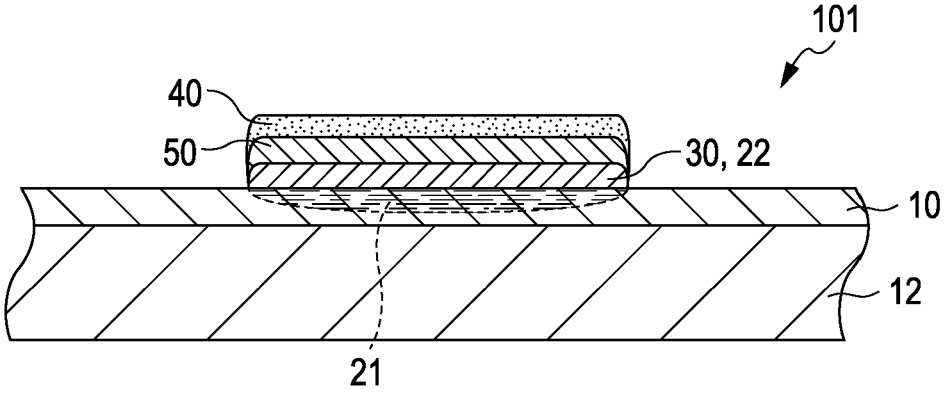
FIG. 13 is a schematic cross-sectional view illustrating an example of a transfer member according to an exemplary embodiment.

First, an example of a configuration of a transfer member will be described. The pigment according to this exemplary embodiment is a glitter pigment. FIG. 13 is a schematic view illustrating an example of configuration of a transfer member. As shown in FIG. 13, the transfer member 101 includes a permeable layer 10, a glitter layer 30 containing a pigment 22 composed of a glitter pigment ink formed on the permeable layer 10, and an adhesive layer 40 having adhesivity formed on the glitter layer 30, wherein a dispersion medium 21 contained in the glitter pigment ink permeates into the permeable layer 10 is arranged. In addition, the transfer member 101 includes a chromatic color layer 50 interposed between the glitter layer 30 and the adhesive layer 40.

Figure 14:
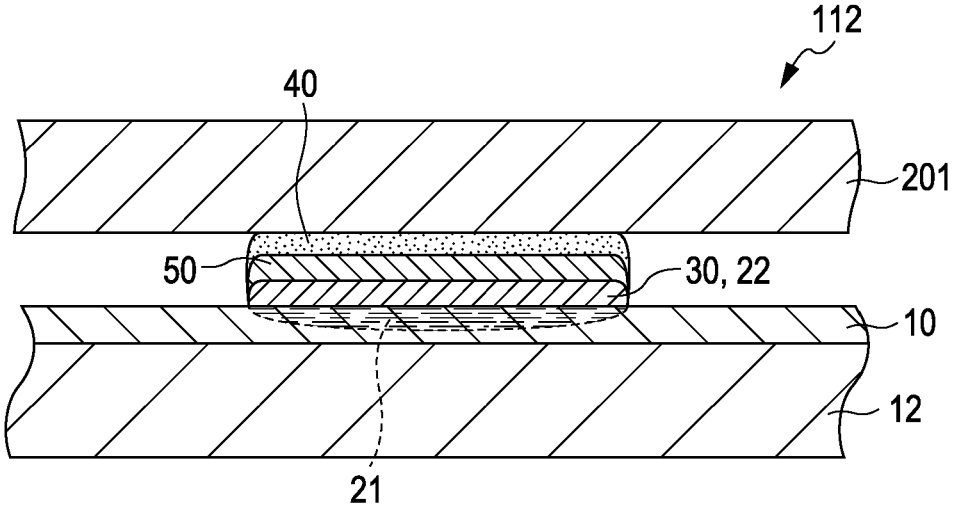
FIG. 14 is a schematic cross-sectional view illustrating an example of a transfer member according to an exemplary embodiment.

FIG. 14 is a schematic view illustrating another example of a configuration of a transfer member. As shown in FIG. 14, the transfer member 112 includes a permeable layer 10, a glitter layer 30 containing a pigment 22 composed of a glitter pigment ink formed on the permeable layer 10 and an adhesive layer 40 having adhesivity formed on the glitter layer 30, wherein a dispersion medium 21 contained in the glitter pigment ink permeates into the permeable layer 10. In addition, the transfer member 112 includes a chromatic color layer 50 interposed between the glitter layer 30 and the adhesive layer 40 and a transferred medium 201 adhered to the adhesive layer 40. In this case, the transferred medium 201 preferably has light permeability. In addition, the adhesive layer 40 is preferably a transparent adhesive material. The thickness of adhesive layer 40 is controlled.

Figure 15:
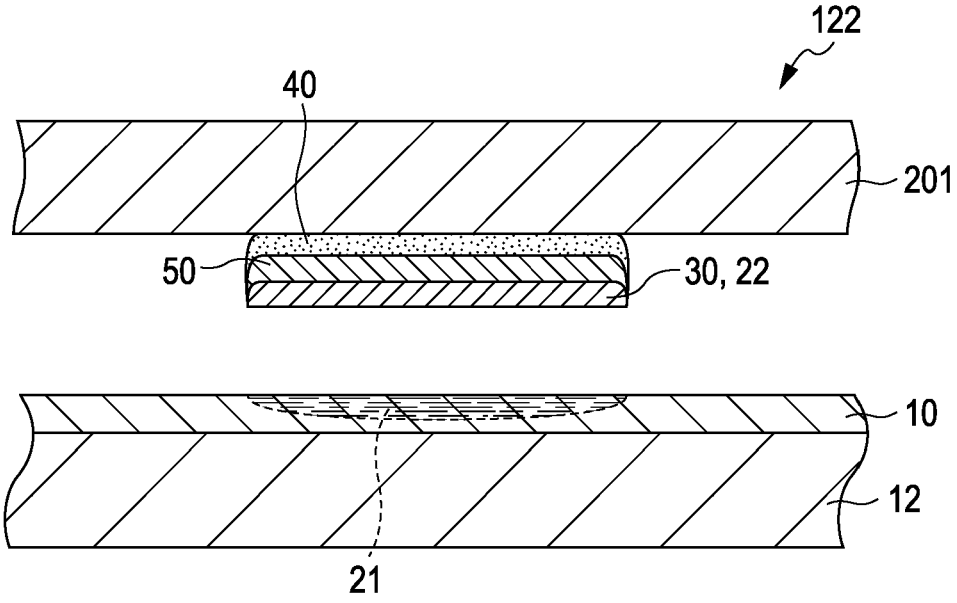
FIG. 15 is a schematic cross-sectional view illustrating an example of a transfer member according to an exemplary embodiment.

FIG. 15 is a schematic view illustrating another example of a configuration of a transfer member. As shown in FIG. 15, the transferred member 122 includes an adhesive layer 40 formed on the transferred medium 201, a chromatic color layer 50 formed on the adhesive layer 40 and a glitter layer 30 formed on the chromatic color layer 50. In this case, preferably, the transferred medium 201 and the adhesive layer 40 have light permeability.

In addition, the substrate 12, the permeable layer 10, the glitter layer 30, the adhesive layer 40 used for the transfer member 101 are the same as in the first exemplary embodiment and a detailed explanation thereof is thus omitted.

4. Method for Manufacturing Transfer Member

Next, a method for manufacturing a transfer member will be described. The manufacturing method of a transfer member according to this exemplary embodiment includes applying a glitter pigment ink to a permeable layer, allowing a dispersion medium contained in the glitter pigment ink to permeate into a permeable layer to form a glitter layer containing a pigment composed of a glitter pigment ink on the permeable layer, forming a chromatic color layer on the glitter layer after formation of the pigment, and forming an adhesive layer on the chromatic color layer after formation of the chromatic color layer.

First, in the process of forming the glitter layer, the glitter layer 30 is formed on the permeable layer 10. In addition, details of the process are the same as in the first exemplary embodiment and are thus omitted (see FIGS. 9 to 11).

Figure 16:
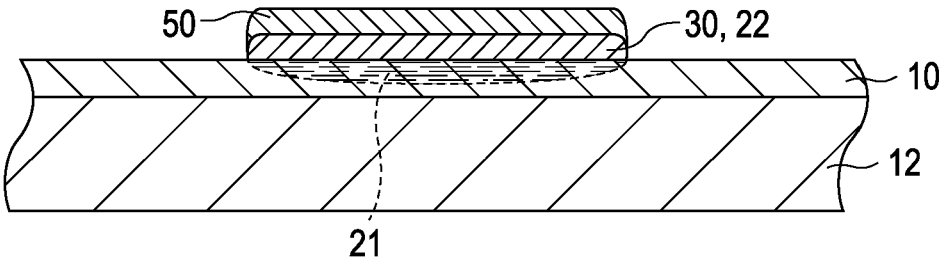
FIG. 16 is a schematic view illustrating a process of an image formation method according to an exemplary embodiment.

Next, in the process of forming the chromatic color layer, as shown in FIG. 16, the chromatic color layer is formed on the glitter layer 30. The method for forming the chromatic color layer 50 on the glitter layer 30 is not particularly limited and examples thereof include ink jet methods, dipping methods (including coating using a brush, a squeegee or the like), bar coating methods, stencil printing methods (screen printing methods), anastatic printing methods and intaglio printing methods. For example, the chromatic color layer may be formed by discharging a functional solution containing a material for chromatic color layer using an ink jet method, applying the functional solution to the glitter layer 30 and solidifying the functional solution.

Figure 17:
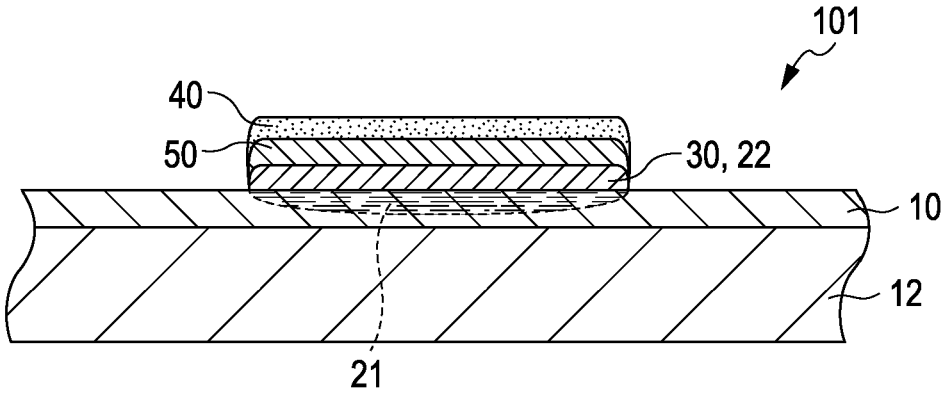
FIG. 17 is a schematic view illustrating a process of an image formation method according to an exemplary embodiment.

Next, in the process of forming the adhesive layer, as shown in FIG. 17, the adhesive layer 40 is formed on the chromatic color layer 50. Preferably, the adhesive layer 40 is transparent. In addition, the formation method of the adhesive layer 40 is the same as in the first exemplary embodiment and an explanation thereof is thus omitted.

Figure 18:
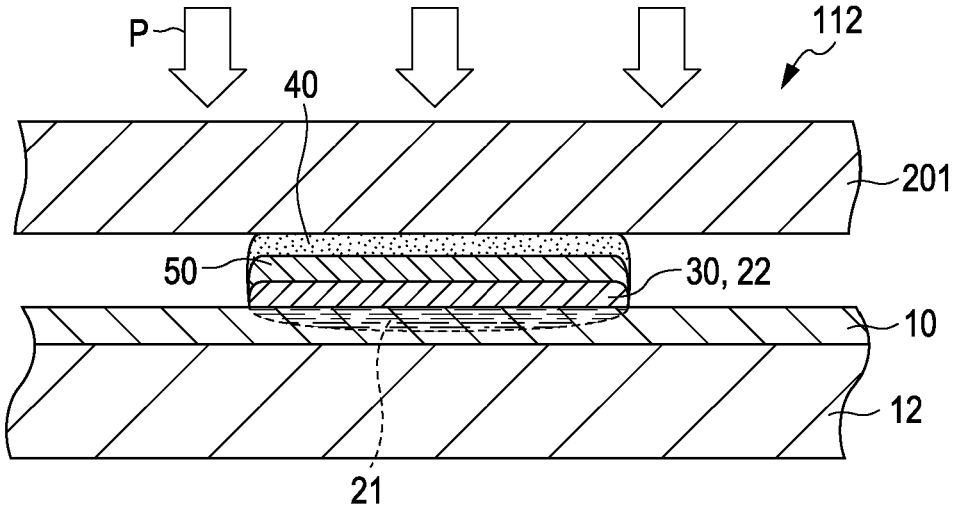
FIG. 18 is a schematic view illustrating a process of an image formation method according to an exemplary embodiment.

Next, in the adhesion process, as shown in FIG. 18, a transferred medium 201 is arranged on the adhesive layer 40, and the transferred medium 201 is adhered to the adhesive layer 40. For example, the transferred medium 201 of this exemplary embodiment is preferably a transparent material such as transparent film.

Next, in the transfer process, as shown in FIG. 15, after the adhesion process, the permeable layer 10 is separated from the glitter layer 30 to transfer the chromatic color layer 50 and the glitter layer 30 to the transferred medium 201. As a result, the chromatic color layer 50 and the glitter layer 30 are transferred to the transferred medium 201 to obtain a transferred member 122. In addition, the transfer method is the same as in the first exemplary embodiment and a detailed explanation thereof is thus omitted.

As described above, according to this exemplary embodiment, the glitter layer 30 and the chromatic color layer 50 can be easily transferred to the transparent transferred medium 201. In addition, when the transferred member 122 to be transferred is seen from the side of the glitter layer 30, images with excellent glossiness can be formed. When observed from the opposite side to the glitter layer 30, that is, the side of the transferred medium 201, color metallic images can be formed through the transferred medium 201 and the adhesive layer 40.

5. Image Forming Device

Figure 19:
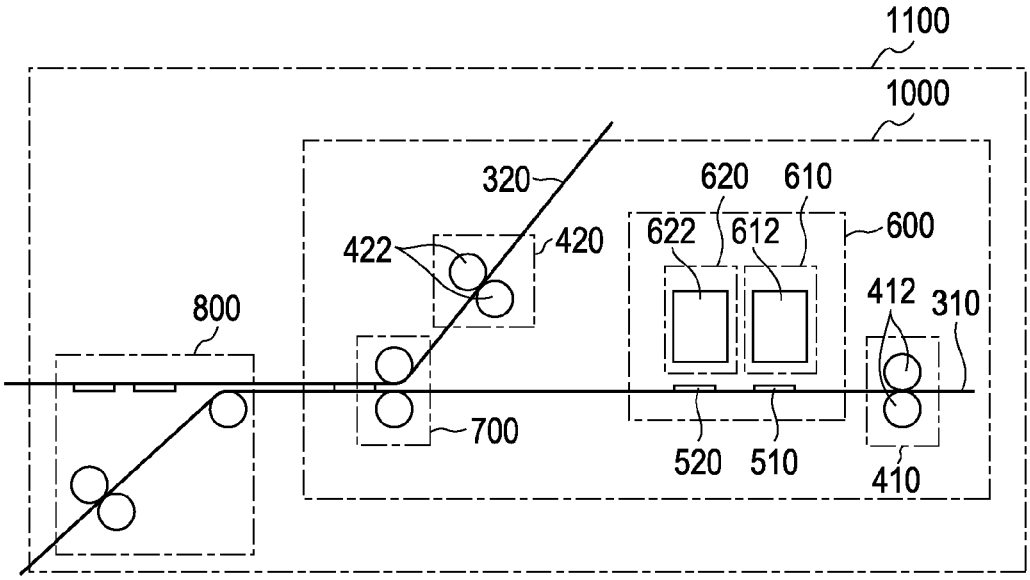
FIG. 19 is a schematic view illustrating an example of an image formation device according to an exemplary embodiment.
Figure 20:
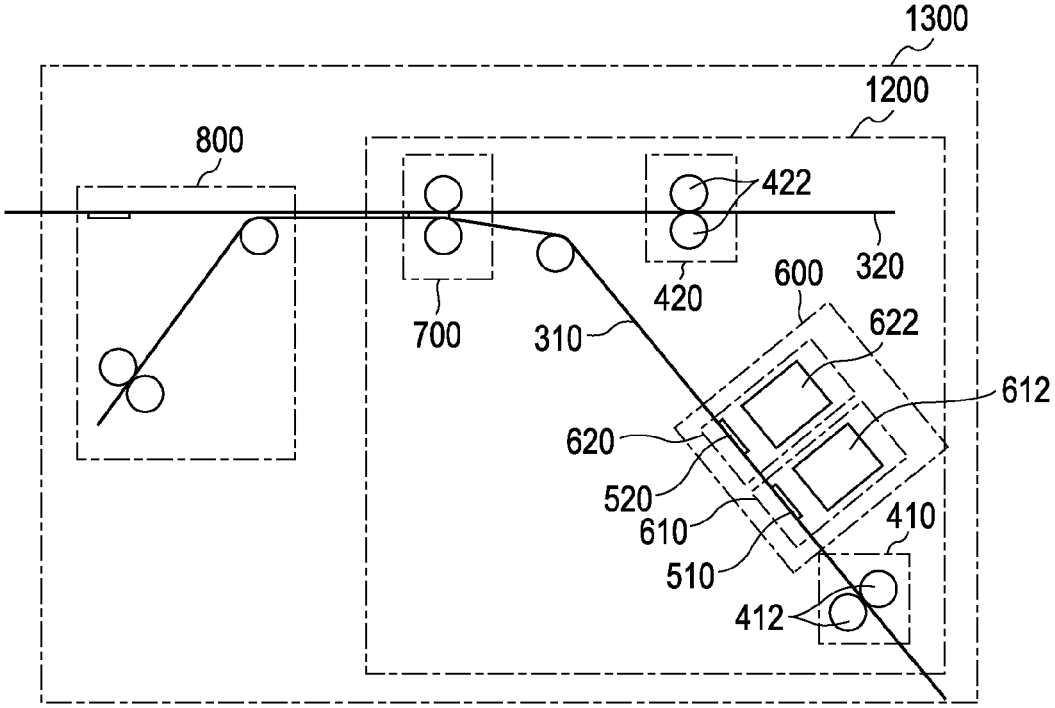
FIG. 20 is a schematic view illustrating an example of an image formation device according to an exemplary embodiment.

FIG. 19 is a schematic view illustrating an image forming device 1000 and 1100 according to an exemplary embodiment. FIG. 20 is a schematic view illustrating an image forming device 1200 and 1300 according to an exemplary embodiment.

The image forming device of this exemplary embodiment includes a first transport unit 410 to transport a first recording medium 310, a second transport unit 420 to transport a second recording medium 320, a first recording unit 610 to record an image using a first ink 510, a second recording unit 620 to record an image using a second ink 520 and a pressurizing unit 700.

5.1. First Transport Unit and Second Transport Unit

The first transport unit 410 transports the first recording medium 310. The second transport unit 420 transports the second recording medium 320.

In this exemplary embodiment, the first recording medium 310 includes the permeable layer 10 as described in the aforementioned exemplary embodiment. In addition, in this exemplary embodiment, the second recording medium 320 corresponds to the transferred medium 200 of the aforementioned exemplary embodiment.

The first transport unit 410 may for example be composed of a roller 412. The first transport unit 410 may include plural rollers 412. In the illustrated example, the first transport unit 410 is mounted above the first recording unit 610 in a direction at which the first recording medium 310 is transported, but the position thereof is not limited thereto. The position and number of the first recording medium 310 may be varied as long as it can be transported.

The second transport unit 420 may for example be composed of a roller 422. The second transport unit 420 may include plural rollers 422. In the illustrated example, the second transport unit 420 is mounted below the second recording unit 620 in a direction at which the first recording medium 310 is transported, and the position thereof is not limited thereto. The position and number of the second recording medium 320 may be varied as long as the second recording medium 320 is arranged such that it is laminated on the first recording medium 310.

The first transport unit 410 and the second transport unit 420 may each independently include a paper feeding roll, a paper feeding tray, a paper ejection roll, a paper ejection tray and a variety of platens, and the first recording medium 310 and the second recording medium 320 are composed in the form of a laminate.

The first recording medium 310 transported through the first transport unit 410 is transported in a position where the first ink 510 is adhered through the first recording unit 610. In addition, the second recording medium 320 transported through the second transport unit 420 is transported to a position where the first recording medium 310 and the second recording medium 320 are pressurized and adhered through the pressurizing unit 700.

Furthermore, a case where the first recording medium 310 and the second recording medium 320 are continuous paper is illustrated in FIGS. 19 and 20. Although at least one of the first recording medium 310 and the second recording medium 320 is a single sheet, transportation of the recording medium as described above can be carried out based on a suitable configuration of the first transport unit 410 and the second transport unit 420.

5.2. First Recording Unit and Second Recording Unit

The first recording unit 610 records an image on the first recording medium 310 using the first ink 510. The second recording unit 620 records an image on the first recording medium 310 using the second ink 520.

The first ink 510 corresponds to the ink 20 in the exemplary embodiment as described above. The second ink 520 contains a liquid to form the adhesive layer 40 (a compound having adhesivity or exhibiting adhesivity in response to a specific stimulus, or a liquid containing the compound) in the exemplary embodiment as described above.

The first recording unit 610 and the second recording unit 620 may utilize a recording unit to obtain the desired image using an ink jet method, a dipping method (including coating using a brush, a squeegee or the like), a bar coating method, a stencil printing method (screen printing), an anastatic printing methods or an intaglio printing method.

The first recording unit 610 forms the pigment layer 30 described in the exemplary embodiment on the first recording medium 310. The second recording unit 620 forms the adhesive layer 40 described in the exemplary embodiment on the first recording medium 310. Accordingly, the first recording unit 610 and the second recording unit 620 are arranged such that the image recorded by the first recording unit 610 is formed on the first recording medium 310 prior to the image recorded by the second recording unit 620. As a result, the transfer member 100 as described in the exemplary embodiment can be formed.

When the first recording unit 610 and the second recording unit 620 utilize an ink jet method, for example, in an exemplary embodiment, the first recording unit 610 and the second recording unit 620 use respective recording heads and the first recording unit 610 is arranged above the second recording unit 620 in a direction in which the first recording medium 310 is transported. In addition, when the first recording unit 610 and the second recording unit 620 utilize an ink jet method, for example, in a case where one recording head is used, the first ink 510 and the second ink 520 are discharged from different nozzles and a discharge timing is controlled such that the first ink 510 reaches the first recording medium 310 prior to the second ink 520. As a result, in spite of using one recording head, segments (units) of respective nozzles may be considered to be as the first recording unit 610 and the second recording unit 620.

In addition, when the first recording unit 610 and the second recording unit 620 utilize using an ink jet method, both of the amount and velocity of the first recording medium 310 transported by the first transport unit 410 are suitably controlled and used and, for example, recording using a serial or line manner may be carried out. In addition, the position relation between the first recording unit 610 and the second recording unit 620 may be changed according to properties of the first recording medium 310 and the first ink 510 and for example, the position relation is suitably designed by the velocity at which the pigment layer 30 is formed on the first recording medium 310 (such as velocity of the dispersion medium 21 permeated into the permeable layer 10 to).

When the first recording unit 610 and the second recording unit 620 utilize using an ink jet method, additional process such as preparing a plate are unnecessary and the desired image can be easily formed and waste of at least one of the first ink 510 and the second ink 520 can be thus inhibited.

5.3. Pressurizing Unit

The pressurizing unit 700 renders the first recording medium 310 to come in contact with the second recording medium 320. Examples of constituent elements of the pressurizing unit 700 include a pressurizing roller, a press molding machine and the like. The velocity and amount of the recording medium transported by respective transport units can be suitably controlled depending on the configuration of the pressurizing unit 700.

The pressurizing unit 700 is arranged below the second recording unit 620 in a direction in which the first recording medium 310 is transported. In addition, the position of the pressurizing unit 700 in the transport direction of the first recording medium 310 is suitably designed depending on the velocity of adhesive layer 40 formed on the first recording medium 310 (drying velocity of adhesive layer 40).

The pressure applied by the pressurizing unit 700 is sufficient as long as it closely brings the first recording medium 310 in contact with the second recording medium 320, and for example, may be suitably determined depending on the type of the adhesive layer 40. For example, in a case where the adhesive layer 40 is composed of a pressure-sensitive adhesive, the pressure applied by the pressurizing unit 700 may be 0.01 Pa to 10 MPa.

The pressurizing unit 700 may include heating equipment. Examples of heating equipment include pressurizing rollers, heaters to control temperature by heating press molders and the like. In addition, examples of the pressurizing unit including heating equipment include main components of a general laminator.

5.4. Other Components

The image forming device of this exemplary embodiment may include a combination of various components.

For example, the image forming device of this exemplary embodiment may include a separation unit 800.

The separation unit 800 is arranged below the pressurizing unit 700 in the transport direction of the first recording medium 310. The separation unit 800 is composed of a roller or a squeegee and may further include a transport unit, if necessary.

The separation unit 800 can separate the first recording medium 310 from the second recording medium 320. As a result, the pigment layer 30 recorded on the first recording medium 310 can be transferred to the second recording medium 320.

5.5. Example of Configuration of Image Forming Device

The configuration of the image forming device of this exemplary embodiment may be varied depending on the intended purpose. For example, in an example shown in FIG. 19 (image recording devices 1000 and 1100), the constituent components are arranged such that the second recording medium 320 is not bent after it passes through the pressurizing unit 700. In this case, the pigment layer 30 transferred on the second recording medium 320 is not bent and for example, detachment or cracks of the pigment layer 30 can be thus suppressed. Meanwhile, in an example shown in FIG. 20, (image recording devices 1200 and 1300), respective constituent components are arranged such that the second recording medium 320 is not bent from beginning to end. This case is applicable to the second recording medium 320 having no flexibility (such as glass sheets or plastic sheets).

In addition, the arrangement of the first recording unit 610 and the second recording unit 620 may be varied. For this reason, for example, although both of them are recording units using an ink jet method, for example, as shown in FIG. 20, the first recording medium 310 does not necessarily extend horizontally. Even in this case, the desired images can be formed by adhering the first ink 510 and the second ink 520 to the first recording medium 310.

The image forming device of this exemplary embodiment may have a configuration controlled to suit the desired recorded material. For example, in a case where the transfer member 110 or the transfer member 111 as shown in FIGS. 3, 4 and 7 is formed, the transfer member 110 or 111 may include components of the image forming devices 1000 and 1200 illustrated in FIGS. 19 and 20, that is, the first transport unit 410, the second transport unit 420, the first recording unit 610, the second recording unit 620 and the pressurizing unit 700. In addition, in a case where the transferred member 120 or the transferred member 121 as shown in FIGS. 5, 6 and 8 is formed, the transferred member 120 or 121 may include the components of image forming devices 1100 and 1300 illustrated in FIGS. 19 and 20, that is, the first transport unit 410, the second transport unit 420, the first recording unit 610, the second recording unit 620, the pressurizing unit 700 and the separation unit 800.

In addition, constituent components of the image forming device of this exemplary embodiment may be each independently or concurrently controlled, and may be integrated or combined together. For example, in a case where the first transport unit 410, and the first recording unit 610 and the second recording unit 620 are used as medium transport units and the recording head 600 of the ink jet recording device, and the pressurizing unit 700 is used as a pressurizing roller of laminator (also serving as the second transport unit 420), the ink jet recording device is combined with the laminator, and the image forming devices 1000 and 1200 of this exemplary embodiment can be realized.

According to the image forming device of this exemplary embodiment, regardless of the type of second recording medium 320, images with good gloss or shine can be easily formed on the second recording medium 320.

6. Example A

Next, a specific Example A of the invention will be described.

1. Preparation of Glitter Pigment Ink

1. Aqueous Silver Ink 17 g of trisodium citrate dihydrate and 0.36 g of tannic acid were dissolved in 50 mL of alkaline water containing 3 mL of a 10N—NaOH aqueous solution. 3 mL of a 3.87 mol/L aqueous silver nitrate solution was added to the resulting solution, followed by stirring for 2 hours to obtain a colloidal silver solution. The resulting colloidal silver solution was diluted until a conduction ratio reached 30 μS/cm or less to perform desalting. After the dilution, centrifugal separation was performed at 3,000 rpm for 10 minutes to remove coarse metal colloid particles. In addition, the mean particle diameter of silver particles was measured using "Microtrac UPA" (available from Nikkiso Co., Ltd.) under conditions of a refractive index of 0.2-3.9i and a refractive index of the solvent (water) of 1.333 and a sphere as a measured particle shape. As a result, the mean particle diameter was 10 nm.

In the method, an aqueous silver ink was prepared from 10% by mass of a colloidal silver solution (solid), a surfactant, 1% by mass of Olfine E1010, 11% by mass of propylene glycol, 5% by mass of 1,2-hexanediol, and the balance % by mass of ion exchange water.

2. Aluminum Ink

In order to obtain a glitter pigment added to the glitter ink, first, a glitter pigment dispersion (aluminum pigment dispersion) was prepared as described below.

A resin layer coating solution composed of 3.0% by mass of cellulose acetate butyrate (butylation ratio: 35 to 39%, a product of Kanto Chemical Co., Ltd.) and 97% by mass of diethylene glycol diethyl ether (a product of Nippon Nyukazai Co., Ltd.) was uniformly applied onto a PET film having a thickness of 100 μm by a bar coating method, followed by drying at 60° C. for 10 minutes to form a resin layer thin film on the PET film.

Then, an aluminum deposition layer having an average thickness of 20 nm was formed on the resin layer using a vacuum deposition apparatus ("VE-1010 vacuum deposition apparatus", manufactured by Vacuum Device Inc.).

Then, the laminate formed by the above-described process was simultaneously peeled, pulverized and dispersed in the presence of diethylene glycol diethyl ether using an ultrasonic disperser (VS-150, manufactured by As One Corp.) and subjected to ultrasonic dispersion treatment for 12 hours in total to prepare a glitter pigment dispersion.

The resulting aluminum pigment dispersion was filtered through an SUS mesh filter with a pore size of 5 μm to remove coarse particles. Then, the filtrate was put in a round-bottomed flask, and diethylene glycol diethyl ether was distilled off using a rotary evaporator to concentrate the aluminum pigment dispersion. Then, the concentration of the aluminum pigment dispersion was controlled to obtain 5% by mass of an aluminum pigment dispersion 1.

Then, a 50% mean particle diameter (d50) in terms of equivalent circle diameter of the glitter aluminum pigment obtained by light scattering was measured using a laser diffraction/scattering-type particle size distribution meter, LMS-2000e (manufactured by Seishin Co., Ltd). As a result, the mean particle diameter was 1.001 μm.

An aluminum pigment ink was prepared from 1.5% by mass of the aluminum pigment dispersion 1 prepared by the method, 64.95% by mass of diethylene glycol diethyl ether (DEGDE), 15% by mass of γ-butyrolactone, 15% by mass of tetraethylene glycol dimethyl ether (TEGDM), 3% by mass of tetraethylene glycol monobutylether (TEGMB) and 0.35% by mass of cellulose acetate butyrate (CAB, manufactured by Kanto Chemical Co., Ltd.; butylation ratio: 35 to 39%) and 0.2% by mass of BYK-UV3500 (trade name, manufactured by BYK-Chemie Japan K.K.). Then, the ink was mixed with stirring in a magnetic stirrer at room temperature and room pressure for 30 minutes to obtain an aluminum ink (glitter ink).

2. Transfer Sheet

The transfer sheet used for this Example was as follows.

(1) Photo paper <gloss> (manufactured by Seiko Epson Corporation)

(2) Photo paper entry (manufactured by Seiko Epson Corporation)

(3) OHP sheet (manufactured by Seiko Epson Corporation)

(4) 12 μm PET film

In addition, the 12 μm PET film was obtained by applying a low-density polymeric polyethylene, wax (trade name: Hi wax 110P, manufactured by Mitsui Chemicals Inc.) to a thickness of 20 nm onto a roll-shaped biaxially-stretched PET film with a width of 600 mm and a thickness of 12 μm and was then used as a release layer. In addition, the thermosetting melamine resin layer prepared from a melamine resin (trade name: Amilac 1000, manufactured by Kansai Paint Co., Ltd.) was applied to a thickness of 10 nm thereto and then cured by heating at 130° C. for 5 minutes to form a protective layer as a substrate of a roll-shaped transfer medium.

3. Method for Manufacturing Transfer Member

Example 1

An aqueous silver ink was applied at 50% of duty to photo paper <gloss> as a transfer sheet using PX-5500 (manufactured by Seiko Epson Corporation) to form an image. Then, the image was dried. In addition, the drying was carried out by first heating the rear surface of the transfer sheet at 50° C. using a platen heater and allowing hot air at 40° C. to come in contact with the image to evaporate the liquid component from the adhered ink. Then, an ink containing an adhesive layer material was discharged from an ink jet head on the surface of the transfer sheet in which an image was formed to form an adhesive layer. Then, the adhesive layer was further evaporated and dried using drying equipment (contact with hot air at 50° C. for 20 seconds) to manufacture a transfer medium. Then, a transferred medium was arranged on the adhesive layer, the adhesive layer was adhered to the transferred medium and an image was separated from the transfer medium. In addition, the transfer was carried out using JOL-DIGITAL-4R230 (manufactured by Japan Office Laminator Co. Ltd.) at a heat-pressing roller temperature of 130° C. and at a pressure of 30 kg/cm$^2$, and a rate of 20 cm/sec.

The "duty" herein used refers to a value calculated by the following equation.

duty(%)=the number of pixels in which recording is actually performed/(height resolution×width resolution)×100

(wherein the number of pixels in which recording is actually performed represents a number of pixels where ink droplets are actually ejected in a unit area, and "height resolution" and "width resolution" represent a resolution recorded in a unit area.)

Example 2

An aqueous silver ink was applied at 50% of duty onto photo paper entry as a transfer sheet using PX-5500 (manufactured by Seiko Epson Corporation) to form an image. The subsequent treatment process was the same as in Example 1.

Example 3

An aluminum ink was applied at 50% of duty onto photo paper <gloss> as a transfer sheet using PX-5500 (manufactured by Seiko Epson Corporation) to form an image. The subsequent treatment process was the same as in Example 1.

Example 4

An aluminum ink was applied at 50% of duty onto photo paper entry as a transfer sheet using PX-5500 (manufactured by Seiko Epson Corporation) to form an image. The subsequent treatment process was the same as in Example 1.

Example 5

An aqueous silver ink was applied at 50% of duty onto EPSON OHP sheet as a transfer sheet using PX-5500 (manufactured by Seiko Epson Corporation) to form an image. The subsequent treatment process was the same as in Example 1.

Example 6

An aqueous solver ink was applied at 50% of duty onto photo paper <gloss> as a transfer sheet using PX-5500 (manufactured by Seiko Epson Corporation) to form a first image. The first image was dried in the same manner as in Example 1, and a yellow pigment ink as a color ink was applied at 50% of duty onto the first image to form a second image.

In addition, the second image was dried in the same manner as in Example 1. Then, an adhesive layer was formed onto the second image. The subsequent treatment process was the same as in Example 1.

Comparative Example 1

An aqueous silver ink was applied at 50% of duty onto a 12 μm PET film as a transfer sheet using PX-5500 (manufactured by Seiko Epson Corporation) to form an image. The subsequent treatment process was the same as in Example 1.

Comparative Example 2

An Eco-sol aluminum ink was applied at 50% of duty onto a 12 μm PET film as a transfer sheet using PX-5500 (manufactured by Seiko Epson Corporation) to form an image. The subsequent treatment process was the same as in Example 1.

In Examples and Comparative Examples, dryness, transferability and glossiness were evaluated. The evaluation results are shown in Table 1.

TABLE 1

| | | Example | | | | | | Comparative Example | |
|---|---|---|---|---|---|---|---|---|---|
| | | 1 | 2 | 3 | 4 | 5 | 6 | 1 | 2 |
| Glitter ink | Aqueous silver ink | ● | ● | | | ● | ● (former strike) | ● | |
| | Eco-sol aluminum ink | | | ● | ● | | | | ● |
| Color ink | Yellow pigment ink | | | | | | ● (latter strike) | | |
| Transfer sheet | Photo paper <gloss> | ● | | ● | | | ● | | |
| | Photo paper entry | | ● | | ● | | | | |
| | PET 12 μm Film | | | | | | | ● | ● |
| | Epson OHP sheet | | | | | ● | | | |

TABLE 1-continued

| | | Example | | | | | | Comparative Example | |
|---|---|---|---|---|---|---|---|---|---|
| | | 1 | 2 | 3 | 4 | 5 | 6 | 1 | 2 |
| Test | Dryness | ○ | ○ | ○ | ○ | ○ | ○ | Δ | X |
| | Transferability | ○ | ○ | ○ | ○ | ○ | ○ | ○ | ○ |
| | Glossiness | ⊙ | ⊙ | ⊙ | ⊙ | ○ | ⊙ | Δ | ⊙ |

4. List of Tests 4.1. Dryness

○: Level at which drying is possible at room temperature.

Δ: Level at which drying is possible under oven drying conditions.

X: Level at which drying is impossible under oven drying conditions.

4.2. Transferability

○: Even and stain-free transfer surface.

X: Stain of 20% or more.

4.3. Glossiness

The glossiness of a recording surface of a transferred member related to Examples and Comparative Examples and Reference Examples was measured using a glossiness meter (MINOLTA MULTI GLOSS 268) at an incident angle of 60 degrees. The glossiness was evaluated based on the following criteria.

©: Glossiness of 400 or more.

○: Glossiness equal to or higher than 350 and lower than 400.

Δ: Glossiness equal to or higher than 300 and lower than 350.

X: Glossiness lower than 300.

As can be seen from Table 1, according to the method for manufacturing the transfer member of the invention, all tests of dryness, transferability and glossiness were superior. Meanwhile, satisfactory results could not be obtained from Comparative Examples.

7. Example B

Next, a specific Example B of the invention will be described. In addition, "Example" described below represents Example B.

1. Preparation of Ink Composition

1. Yellow Ink A 100 g of a yellow pigment (C.I. pigment yellow 74) and 28 g of aminopropyl dihydrogen phosphate were mixed with 720 g of water, and 16.2 g of acetic acid was added dropwise to the mixture, followed by stirring at 70° C.

After several minutes, a solution obtained by dissolving 10.7 g of sodium nitrite in 50 g of water was added thereto, followed by further stirring for one hour.

The slurry thus obtained was filtered using filter paper (trade name: GA-100; manufactured by Advantec Toyo Kaisha Ltd.) and washed with water.

The resulting wet cake was re-dispersed in 5 kg of water, desalted and purified through a reverse permeation membrane until the conductivity reached 2 mS/cm, and concentrated such that the concentration of pigment became 50% by mass to obtain a yellow dispersion in which pigment particles having surface carboxyl groups and hydroxyl groups as hydrophilic functional groups were dispersed.

The dispersion, a nonionic surfactant (Olfine® E1010 manufactured by Nissin Chemical Industry Co., Ltd.), propylene glycol, 1,2-hexanediol, 2-pyrrolidone and ion exchange water were mixed at a ratio shown in Table 1 to obtain a yellow ink A.

3. Magenta Ink A

A magenta dispersion in which pigment particles having surface carboxyl groups and hydroxyl groups as hydrophilic functional groups were dispersed was obtained in the same manner as described above, except that C.I. pigment red 122 was used as a pigment.

This dispersion, a nonionic surfactant (Olfine® E1010 manufactured by Nissin Chemical Industry Co., Ltd.), propylene glycol, 1,2-hexanediol, 2-pyrrolidone and ion exchange water were mixed at a ratio shown in Table 1 to obtain a magenta ink A.

4. Cyan Ink A

A cyan dispersion in which pigment particles having surface carboxyl groups and hydroxyl groups as hydrophilic functional groups were dispersed was obtained in the same manner as described above, except that C.I. pigment blue 15:3 was used as a pigment.

This dispersion, a nonionic surfactant (Olfine® E1010 manufactured by Nissin Chemical Industry Co., Ltd.), propylene glycol, 1,2-hexanediol, 2-pyrrolidone and ion exchange water were mixed at a ratio shown in Table 1 to obtain a cyan ink A.

5. Color Inks of Resin Dispersion

As color inks of resin dispersion, yellow ink B (ICY37, manufactured by Seiko Epson Corporation), magenta ink B (ICM37, manufactured by Seiko Epson Corporation) and cyan ink B (ICC37, manufactured by Seiko Epson Corporation) were prepared.

2. Preparation of Glitter Ink 17 g of trisodium citrate dihydrate and 0.36 g of tannic acid were dissolved in 50 mL of alkaline water containing 3 mL of a 10N—NaOH aqueous solution. 3 mL of a 3.87 mol/L aqueous silver nitrate solution was added to the resulting solution, followed by stirring for 2 hours to obtain a colloidal silver solution. The resulting colloidal silver solution was diluted until a conduction ratio reached 30 μS/cm or less to perform desalting. After the dilution, centrifugal separation was performed at 3,000 rpm for 10 minutes to remove coarse metal colloide particles. In addition, the mean particle diameter of silver particles was measured using "Microtrac UPA" (available from Nikkiso Co., Ltd.) under conditions of a refractive index of 0.2-3.9i and a refractive index of the solvent (water) of 1.333 and a sphere as a measured particle shape.

Components shown in Table 2 were added to the colloidal silver solution thus prepared to obtain a glitter ink as shown in Table 1.

3. Respective Components of a Material Containing an Adhesive Compound (Adhesive Layer-Forming Ink)

Components shown in Table 2 were mixed in amounts shown in Table 2 to obtain an adhesive layer-forming ink.

In addition, a vinyl chloride adhesive (manufactured by Nissin Chemical Industry Co., Ltd.) was used as a vinyl chloride emulsion.

TABLE 2

| | Yellow ink A [% by mass] | Magenta Ink A [% by mass] | Cyan ink A [% by mass] | Glitter ink [% by mass] | Adhesive layer-forming ink [% by mass] |
|---|---|---|---|---|---|
| Silver dispersion | — | — | — | 10 | — |
| Yellow dispersion | 4 | — | — | — | — |
| Magenta dispersion | — | 4 | — | — | — |

TABLE 2-continued

| | Yellow ink A [% by mass] | Magenta Ink A [% by mass] | Cyan ink A [% by mass] | Glitter ink [% by mass] | Adhesive layer-forming ink [% by mass] |
|---|---|---|---|---|---|
| Cyan dispersion | — | — | 4 | — | — |
| Vinyl chloride emulsion | | | | | 10 |
| Olfine E1010 | 1 | 1 | 1 | 1 | 1 |
| Propylene glycol | 11 | 11 | 9 | 10 | 11 |
| 1,2-hexane diol | 5 | 5 | 5 | 5 | 5 |
| 2-pyrrolidone | 2 | 2 | 2 | 2 | 2 |
| Ion exchange water | Balance | Balance | Balance | Balance | Balance |

4. Manufacturing of Heat Transfer Medium

Example 1

A clear porous film having a porous layer as a release sheet (manufactured by Seiko Epson Corporation, trade name "EPSON OHP sheet") was prepared, and a yellow ink A was applied at 50% of duty onto the corresponding release sheet by PX-G930 (manufactured by Seiko Epson Corporation) to form an image layer.

Then, the formed image layer was dried.

Next, an adhesive layer-forming ink was applied to 50% of duty onto the image layer using PX-G930 (manufactured by Seiko Epson Corporation) and dried to form an adhesive layer.

Examples 2 and 3

A heat transfer medium was manufactured in the same manner as Example 1 except that the ink composition shown in Table 3 was used.

Example 4

A clear porous film having a porous layer as a release sheet (manufactured by Seiko Epson Corporation, trade name "EPSON OHP sheet") was prepared, and a yellow ink A was applied at 50% of duty onto the corresponding release sheet by PX-G930 (manufactured by Seiko Epson Corporation), and a glitter ink was applied to 50% of duty onto the yellow ink to form an image layer.

Then, the formed image layer was dried.

Next, an adhesive layer-forming ink was applied to 50% of duty onto the image layer using PX-G930 (manufactured by Seiko Epson Corporation) and dried to form an adhesive layer.

Examples 5 and 6

A heat transfer medium was manufactured in the same manner as Example 1 except that the ink composition shown in Table 3 was used.

Comparative Examples 1 to 4

A heat transfer medium was manufactured in the same manner as Example 1 except that the ink composition shown in Table 3 was used.

duty(%)=the number of pixels in which recording is actually performed/(height resolution×width resolution)×100

(wherein the number of pixels in which recording is actually performed represents a number of pixels where ink droplets are actually ejected in a unit area, and "height resolution" and "width resolution" represent a resolution recorded in a unit area.)

TABLE 3

| | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|
| Yellow ink A | ● | — | — | ● | — | — | — | — | — | — |
| Magenta ink A | — | ● | | | ● | | — | — | — | — |
| Cyan ink A | — | | ● | | | ● | — | — | — | — |
| Yellow ink B | — | | | | | | ● | | | ● |
| Magenta ink B | — | | | | | | | ● | | |
| Cyan ink B | — | | | | | | | | ● | |
| Glitter ink | — | | | ● | ● | ● | | | | ● |
| Transferability | ⊙ | ⊙ | ⊙ | ⊙ | ⊙ | ⊙ | X | X | X | X |
| Gloss after transfer | — | — | — | ⊙ | ⊙ | ⊙ | — | — | — | X |

5. Evaluation of Image Transferability

Recording media as paper media (super fine paper: manufactured by Seiko Epson Corporation) were prepared, and images were transferred to recording media using heat transfer media of respective Examples and Comparative Examples to obtain recorded materials. The image transferability of the recorded materials was evaluated based on the following criteria.

©: Transfer surface was even and had no peel stain.

○: Transfer surface had peel stain of 5% or less.

Δ: Transfer surface had peel stain higher than 5% and equal to or lower than 20%.

x: Transfer surface had peel stain higher than 20%.

6. Evaluation of Glossiness (60 Degrees)

Glossiness of the recorded materials related to respective Examples Comparative Examples obtained in [5] was measured at an incident angle of 60 degrees using a glossiness meter (MINOLTA MULTI GLOSS 268). The glossiness of the recorded materials was evaluated based on the following criteria.

©: Glossiness (60 degrees) equal to or higher than 300, and strong metallic glossiness ○: Glossiness (60 degrees) equal to or higher than 100 and lower than 299, and metallic glossiness x: Glossiness (60 degrees) lower than 99, and no metallic glossiness (reflection of light)

The results are shown in Table 2.

As apparent from Table 3, the heat transfer media of Examples exhibited superior image transferability. In addition, the heat transfer media of Examples 4 to 6 exhibited superior photoluminescence property. On the other hand, the heat transfer media of Comparative Examples could not exhibit satisfactory results.

The invention is not limited to the aforementioned exemplary embodiments and may be provided as a variety of modified forms. For example, the invention includes the substantial same configurations as described in the exemplary embodiments (such as, configurations having the same functions, methods and results). In addition, the invention includes configurations in which inessential components of configurations described in exemplary embodiments are substituted. In addition, the invention includes configurations which have the same actions and effects or accomplish the same objects as configurations described in the exemplary embodiments. In addition, the invention includes a combination of configurations described in the exemplary embodiments and known techniques.

What is claimed is:

1. A transfer member comprising:

a porous layer that is substantially impermeable to a pigment of an ink;

a pigment layer formed on the porous layer by an ink jet method;

a chromatic color layer formed on the pigment layer; and an adhesive layer having adhesivity formed on the chromatic color layer, wherein a dispersion medium of the ink permeates into the porous layer and the pigment of the ink forms the pigment layer.

2. The transfer member according to claim 1, wherein a transferred medium is disposed with respect to the adhesive layer and the pigment layer is adhered to the transferred medium through the adhesive layer.

3. The transfer member according to claim 1, wherein the pigment is a pigment dispersed by a method other than dispersion of a glitter pigment or resin.

4. A transfer member according to claim 1, wherein the porous layer comprises inorganic particles having a mean particle diameter of 3 to 300 nm.

5. A transfer member according to claim 1, wherein a mean particle diameter of the pigment is between 3 and 200 nm.

6. A method for manufacturing a transfer member comprising:

adhering an ink containing a pigment to a porous layer that is substantially impermeable to the pigment by an ink jet method and allowing at least a part of a dispersion medium of the ink to permeate into the porous layer to form a pigment layer on the porous layer;

forming a chromatic color layer on the pigment layer;

forming an adhesive layer having adhesivity on the chromatic color layer; and disposing a transferred medium with respect to the adhesive layer and adhering the transferred medium to the pigment layer.

7. The method according to claim 6, wherein the formation of the adhesive layer is carried out using an ink jet method.

8. The method according to claim 6, wherein the pigment is a pigment dispersed by a method other than dispersion of a glitter pigment or resin.

9. The method for manufacturing a transfer member according to claim 8, wherein the transferred medium has an arithmetical mean roughness (Ra) of 20 μm or more, or no ink-absorbency or low ink-absorbency.

10. A transferred member formed by the method according to claim 9, the transferred member comprising the transferred medium, the adhesive layer and the pigment layer.

11. The method according to claim 6, wherein the pigment has a mean particle diameter of 3 nm to 200 nm.

12. The method for manufacturing a transfer member according to claim 5, further comprising:

separating the porous layer from the pigment layer and transferring the pigment layer from the porous layer to the transferred medium.

13. A transferred member formed by the method according to claim 12, the transferred member comprising the transferred medium, the adhesive layer and the pigment layer.

14. A method for manufacturing a transfer member comprising:

adhering an ink containing a pigment to a porous layer that is substantially impermeable to the pigment by an ink jet method and permeating a dispersion medium of the ink into the porous layer to form a pigment layer on the porous layer;

forming a chromatic color layer on the pigment layer; and disposing a transferred medium including an adhesive layer having adhesivity with respect to the pigment layer and adhering the transferred medium to the pigment layer through the adhesive layer.

* * * * *